US006991327B2

(12) United States Patent
Goto et al.

(10) Patent No.: US 6,991,327 B2
(45) Date of Patent: Jan. 31, 2006

(54) INKJET RECORDING METHOD, INKJET RECORDING APPARATUS, PROGRAM AND STORAGE MEDIUM STORING PROGRAM CODE READABLE BY COMPUTER

(75) Inventors: Fumitaka Goto, Yokohama (JP); Kentaro Yano, Yokohama (JP); Masao Kato, Utsunomiya (JP); Mitsuhiro Ono, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 608 days.

(21) Appl. No.: 10/137,382

(22) Filed: May 3, 2002

(65) Prior Publication Data

US 2003/0117453 A1 Jun. 26, 2003

(30) Foreign Application Priority Data

May 9, 2001 (JP) ..... 2001-138485
Apr. 8, 2002 (JP) ..... 2002-105082

(51) Int. Cl.
*B41J 2/17* (2006.01)
*B41J 2/01* (2006.01)

(52) U.S. Cl. ..... 347/96; 347/101

(58) Field of Classification Search ..... 347/96, 347/98, 101, 9, 12, 13, 43
See application file for complete search history.

(56) References Cited

U.S. PATENT DOCUMENTS

| | | | |
|---|---|---|---|
| 4,202,870 | A | 5/1980 | Weber et al. |
| 4,242,271 | A | 12/1980 | Weber et al. |
| 4,313,124 | A | 1/1982 | Hara |
| 4,330,787 | A | 5/1982 | Sato et al. |

(Continued)

FOREIGN PATENT DOCUMENTS

| | | |
|---|---|---|
| EP | 0 534 634 | 3/1993 |
| EP | 1 043 166 | 10/2000 |
| JP | 54-56847 | 5/1979 |
| JP | 55-150396 | 11/1980 |
| JP | 59-123670 | 7/1984 |
| JP | 59-138461 | 8/1984 |
| JP | 60-71260 | 4/1985 |
| JP | 61-59911 | 12/1986 |
| JP | 61-59912 | 12/1986 |
| JP | 61-59914 | 12/1986 |
| JP | 63-22681 | 1/1988 |
| JP | 63-60783 | 3/1988 |
| JP | 63-299971 | 12/1988 |
| JP | 64-9279 | 1/1989 |

(Continued)

OTHER PUBLICATIONS

Barrett, et al., "The Determination of Pore Volume and Area Distributions in Porous Substances. I. Computations from Nitrogen Isotherms," The Journal of the American Chemical Society, Jan.–Mar. 1951, vol. 73, pp. 373–380.

*Primary Examiner*—Michael S. Brooke
(74) *Attorney, Agent, or Firm*—Fitzpatrick, Cella, Harper & Scinto

(57) ABSTRACT

An ink jet recording method effects recording on a recording material by ejecting ink comprising coloring material and reaction liquid reactable with the ink from an ink ejection portion for ejecting the ink and a reaction liquid ejection portion for ejecting the reaction liquid. The method includes a recording step of effecting the recording selectively in a first recording mode in which no margin is provided at least one end portion of the recording material and a second recording mode in which margins are provided at all of the end portions of the recording material. A recording condition in the first recording mode and a recording condition in the second recording mode are different.

38 Claims, 12 Drawing Sheets

U.S. PATENT DOCUMENTS 4,345,262 A 8/1982 Shirato et al.
4,459,600 A 7/1984 Sato et al.
4,463,359 A 7/1984 Ayata et al.
4,558,333 A 12/1985 Sugitani et al.
4,608,577 A 8/1986 Hori
4,694,302 A 9/1987 Hackleman et al.
4,723,129 A 2/1988 Endo et al.
4,740,796 A 4/1988 Endo et al.
5,359,355 A * 10/1994 Nagoshi et al. ..... 347/9
5,428,383 A 6/1995 Shields et al.
5,485,188 A 1/1996 Tochihara et al.
5,618,338 A 4/1997 Kurabayashi et al.
5,917,519 A * 6/1999 Arai et al. ..... 347/41
6,003,987 A 12/1999 Yamamoto et al.
6,089,697 A 7/2000 Tajika et al.
6,099,116 A 8/2000 Fujita et al.
6,120,141 A 9/2000 Tajika et al.
6,139,139 A * 10/2000 Stoffel et al. ..... 347/96
6,155,666 A 12/2000 Sugimoto et al.
6,188,430 B1 * 2/2001 Motai ..... 348/207.99
6,264,320 B1 7/2001 Moriyama et al.
6,329,817 B1 * 12/2001 Moginine Gummer et al. ..... 324/251
6,517,199 B1 * 2/2003 Tomioka et al. ..... 347/101
2002/0036664 A1 3/2002 Arima et al.

FOREIGN PATENT DOCUMENTS

JP 64-63185 3/1989
JP 5-202328 8/1993
JP 6-100811 4/1994
JP 6-106841 4/1994
JP 6-191143 7/1994
JP 8-72393 3/1996
JP 8-224955 9/1996
JP 8-336961 12/1996
JP 2000-351205 12/2000

* cited by examiner

INKJET RECORDING METHOD, INKJET RECORDING APPARATUS, PROGRAM AND STORAGE MEDIUM STORING PROGRAM CODE READABLE BY COMPUTER

FIELD OF THE INVENTION AND RELATED ART

The present invention relates to technologies for recording an image superior in color development and color uniformity, with the use of a combination of ink and liquid reactive to ink. In particular, it relates to an optimal recording method for recording without a recording apparatus capable of carrying out such a recording method, a program for controlling such a recording apparatus, and a recording medium.

In an inkjet recording method, an image is recorded on a recording medium, for example, a piece of paper, by ejecting ink so that it adheres to the recording medium. For example, Japanese Patent Application Publications 61-59911, 61-59912 and 61-59914 disclose inkjet recording methods, in which electrothermal transducers are employed as means for supplying thermal energy which is applied to ink to generate bubbles in the ink so that the ink is ejected in the form of ink droplets. These inkjet recording methods make it possible to realize a recording head provided with a large number of ejection orifices arranged in high density, which makes it possible to record a high quality image at a high speed and a high resolution.

The ink used for an inkjet recording method in accordance with the prior art generally contains water, which is the main ingredient, and a water-soluble solvent with a high boiling point, such as glycol, which is for the purpose of preventing nozzles from becoming plugged, and the like. Thus, the usage of such ink sometimes results in the formation of a nonuniform image, the causes of which are presumed to be insufficient fixation, nonuniform distribution of filler and sizing agent across the surface of the recording paper as the recording medium. In addition, in recent years, there has been a growing trend of requiring even inkjet prints to be as high in image quality as a prints produced by silver-salt photography. Therefore, demand has been increased for technologies capable of improving an inkjet recording method in image density, color reproduction range, and color uniformity.

With the foregoing in mind, various proposals have been made to improve an inkjet recording method in terms of reliability and image quality. One of such proposals relates to the recording medium itself, more specifically, a method for coating filler and/or sizing agent on the surface of the substrate, that is, base paper, of the recording medium; for example, technologies for coating, as filler, microscopic porous particles capable of absorbing coloring agent on the base paper in order to form an ink catching layer from the particles. As a matter of fact, a recording medium manufactured with the use of these technologies has been available for sale as "coated paper for inkjet".

In this environment, various proposals based on reactivity have been made in order to improve an inkjet recording method in terms of reliability and image quality. These proposals may be summarized as follows:

(1) Method for mixing ink and liquid compound reactive to ink, on recording medium; for the purpose of improving the recording medium in image density, waterproofing, and bleeding, liquid compound capable of improving image quality is applied to the surface of recording medium before or immediately after ink is ejected to record an image.

For example, a recording method in which an image is recorded, with the use of an ink containing anion dye, after adhering a liquid composition containing basic polymers to a recording medium is disclosed in Japanese Laid-Open Patent Application No. 63-60783, and a recording method in which a first liquid composition containing reactive chemical seeds and a second liquid composition containing chemical compounds reactive to the reactive chemical seeds in the first liquid composition are mixed on recording medium is disclosed in Japanese Laid-Open Patent Application No. 63-22681. Further, in Japanese Laid-Open Patent Application No. 63-299971, a recording method in which recording is made using an ink containing anionic dye after adhering a liquid composition containing organic chemical compounds having two or more cationic radicals per molecule to a recording medium is disclosed. Further, Japanese Laid-Open Patent Application No. 64-9279 discloses a recording method in which recording is made using an ink containing anionic dye after adhering an acidic liquid composition containing succinic acid to a recording medium.

Further, in Japanese Laid-Open Patent Application No. 64-63185, a method in which a liquid composition capable of insolubilizing dye is applied to paper before applying ink to the paper is disclosed. Also in Japanese Laid-Open Patent Application No. 8-224955, a method in which liquid composition containing cationic substances different in molecular weight distribution is used in combination with ink containing anionic chemical compounds is disclosed. Further, Japanese Laid-Open Patent Application No. 8-72393 discloses a method in which liquid composition containing cationic substance and pulverized cellulose is used in combination with ink. All applications claim that their recording methods can produce images high in density, excellent in print quality and water resistance, and also excellent in terms of color reproduction and bleeding. Further, in Japanese Laid-Open Patent Application No. 55-150396, a method in which a water-proofing agent which forms a lake by reacting with dye is applied after recording is made on a recording medium using dye based ink is disclosed for the purpose of water-proofing the recorded images.

Disclosed in Japanese Laid-Open Patent Application No. 5-202328 is that by adhering ink containing dye having carboxyl radicals to a recording medium after applying to the recording medium a polyvalent metallic salt solution containing polyvalent metallic cations of a minimum of one of the following types: $Ca^{++}$, $Cu^{++}$, $Ni^{++}$, $Mg^{++}$, $Zn^{++}$, $Ba^{++}$, $Al^{+++}$, $Fe^{+++}$, and $Cr^{+++}$, the recording medium is better waterproofed, and bleeding is reduced.

(2) Method in which inks reactive to each other are mixed on recording medium:

Japanese Laid-Open Patent Application No. 6-100811 discloses that by using cationic dye as the material for black ink, and anionic dyes as the material for inks other than black ink, it is possible to improve the quality of the black portions of an image, and also to reduce bleeding. Further, Japanese Laid-Open Patent Application No. 6-191143 discloses that by using three color inks containing anionic dyes, in combination with color ink containing cationic dye capable of forming black color by being mixed with at least one of the three color inks, it is possible to improve the quality of the black portions of an image, and also to reduce bleeding.

Further, Japanese Laid-Open Patent Application No. 6-106841 discloses a method in which bleeding is reduced by causing ink containing polyvalent metallic cations of a minimum of one of the following types: Ca++, Cu++, Co++, Ni++, Fe++, La+++, Nd+++, Y+++ and Al+++, to react with ink containing a coloring agent different from the coloring agents for the preceding inks.

Hereinafter, a combination of one of the above-described inks and one of the above described liquid compositions, which are reactive to each other, and a combination of the above described two inks reactive to each other, will be called a "reactive system", and the recording made using a reactive system will be called "reactive system based recording".

Recently, demand has been increasing for an inkjet recording apparatus capable of recording an image in a manner to cover the entire surface of a recording medium, that is, without leaving any margin, as is in the case of some of the prints produced using silver salt photography. In other words, demand has been increasing for means for recording a borderless image (which hereinafter may be referred to as a brim-less, or margin-less image). For this purpose, the following proposals have been made.

In Japanese Laid-Open Patent Application No. 2000-351205, an inkjet recording apparatus and recording method, which have been devised to prevent a recording medium from being soiled by the ink ejected outward of the edge of the recording medium when an image is formed without the provision of a margin along the leading edge, trailing edge, and/or both edges of the recording medium, are disclosed. FIG. 5 is a schematic drawing of an inkjet recording apparatus. In Japanese Laid-Open Patent Application No. 2000-351205, the platen 1811 of an image forming apparatus is provided with a hole as shown in FIG. 5, and the soiling of a recording medium by the ink is prevented by guiding the ink ejected outward of the recording medium edge into the hole.

In the past, it was not known to combine a recording means based on a reactive system, such as those described above, with a recording means for recording without the provision of any margin (brim-less recording) such as those described above. Thus, the inventors of the present invention tried to simply combine so that recording could be made using a combination of ink and reactive liquid (liquid reactive to ink), without the provision of any margin, under the conditions identical to the conditions under which recording is made with the provision of margins along all edges of a recording medium (normal recording mode). In this method for recording without margins, the contamination of the interior of the recording apparatus and the reverse side of a recording medium, and deterioration of the liquid absorbing capacity of the absorbent member placed in the recording medium path (absorbent member placed in the hole of the platen), and the like problems, were observed.

More concretely, the inventors of the present invention recorded borderless images using one of the above described reactive systems, in combination with the above described borderless (brim-less, margin-less) recording method: recording was made without any margin, using the technology (1) (ink and liquid composition are mixed on the recording medium), and the technology (2) (inks reactive to each other are mixed on the recording medium). As a result, it was discovered that the chemical compounds resulting from the reactive system adhered to the interior of the inkjet recording apparatus and the reverse side of the recording medium, soiling the interior of the inkjet recording apparatus and the reverse side of the recording medium. Further, recording was made without any margin, using the technology (1) (ink and liquid composition are mixed on the recording medium), and the technology (2) (inks reactive to each other are mixed on the recording medium). As a result, it was discovered that the ink and reactive liquid reached each other in the absorbent member placed in the recording medium conveyance path (placed in the hole in the platen), producing chemical compounds, which reduced the absorbing capacity of the absorbent member. It was also discovered that in addition to reducing the absorbing capacity of the absorbent member, the chemical compounds which adhered to the absorbent member contaminated the reverse side of the recording medium, and that as the amount of the chemical compounds increased, the chemical compounds interfered with the recording medium conveyance.

Incidentally, it was a new discovery, that is, a fact never known in the past, that when recording without any margin image using the above-described reaction system, the interior of a recording apparatus and the reverse side of a recording medium are contaminated by the chemical compounds. It was also a new discovery that when recording without any margin using the above-described reaction system, the ink and reactive liquid ejected outward of the edges of a recording medium reacted with each other in the absorbent member placed in the recording medium conveyance path, producing chemical compounds, which deteriorated the liquid absorbing capacity of the absorbent member and interfered with the recording medium conveyance. Further, it was also a new discovery that making the conditions, under which recording was made without any margin, the same as those, under which recording was normally made, was not desirable in terms of the various aspects of a recording operation.

SUMMARY OF THE INVENTION

The present invention was made based on the above-described new discoveries, and its primary object is to provide an inkjet recording method and an inkjet recording apparatus capable of preventing, reducing, or controlling the contamination of the interior of the inkjet recording apparatus and reverse side of a recording medium, which occurs when recording is made without any margin, using both ink and reactive liquid.

Another object of the present invention is to provide an inkjet recording method and an inkjet recording apparatus capable of preventing, reducing, or controlling the deterioration of the liquid absorbing capacity of the absorbent member placed in the recording medium conveyance path, and the interference with the recording medium conveyance, which occur when recording is made without any margin, using both ink and reactive liquid.

Another object of the present invention is to provide programs for causing a computer to realize the above-described recording methods, and a storage medium storing such programs.

According to an aspect of the present invention, there is provided an ink jet recording method for effecting recording on a recording material by ejecting ink comprising coloring material and reaction liquid reactable with the ink from an ink ejection portion for ejecting the ink and a reaction liquid ejection portion for ejecting the reaction liquid, said method comprising a recording step of effecting the recording selectively in a first recording mode in which no margin is provided at least at one end portion on a surface of the recording material and a second recording mode in which no margin is provided at any end portion of the surface of the recording material; wherein a recording condition in said first recording mode and a recording condition in said second recording mode are different.

According to another aspect of the present invention, there is provided an ink jet recording apparatus for effecting recording on a recording material by ejecting ink comprising coloring material and reaction liquid reactable with the ink from an ink ejection portion for ejecting the ink and a reaction liquid ejection portion for ejecting the reaction liquid, said apparatus comprising recording means for effecting the recording selectively in a first recording mode in which no margin is provided at least at one end portion on a surface of the recording material and a second recording mode in which no margin is provided at any end portion of the surface of the recording material; wherein a recording condition in said first recording mode and a recording condition in said second recording mode are different.

According to a further aspect of the present invention, there is provided a control program for computer control of an ink jet recording method for effecting recording on a recording material by ejecting ink comprising coloring material and reaction liquid reactable with the ink from an ink ejection portion for ejecting the ink and a reaction liquid ejection portion for ejecting the reaction liquid, said program comprising: a discrimination step of discriminating a selected mode of a first recording mode in which no margin is provided at least at one end portion on a surface of the recording material and a second recording mode in which no margin is provided at any end portion of the surface of the recording material and in which the recording is effected in a recording condition which is different from a recording condition in the first mode; and a preparation step of preparing data for recording ink ejection and ejection data for the reaction liquid in the first recording mode when said discrimination step discriminates that the first recording mode is selected, and preparing data for recording ink ejection and ejection data for the reaction liquid in the second recording mode when said discrimination step discriminates that the second recording mode is selected.

According to a further aspect of the present invention, there is provided a storing medium readable by a computer storing the control program as defined above.

The above-described recording conditions in the present invention are desired to include at least one of a condition regarding at least one of the amounts by which the above-described ink and reactive liquid are applied, a condition regarding the number of times the above-described ink ejecting portion and reactive liquid ejection portion make scanning movements, and a condition regarding the regions on and off a recording medium toward which the above-described ink and relative liquid are ejected. Further, it is desired that in the above described first and second recording modes, a minimum of one condition is varied among the condition regarding the amounts by which ink and reactive liquid are applied, the condition regarding the scan count, and the condition regarding the regions toward which the ink and reactive liquid are ejected.

According to the above structural arrangement, the recording condition under which recording is made in the first mode, that is, the mode in which recording is made without any margin, is made different from the recording condition under which recording is made in the second recording mode, that is, the mode in which recording is normally made (recording is made with margins). Therefore, the above-described various problems (contamination of the recording apparatus interior or the reverse side of the recording medium, deterioration of liquid absorbing capacity of the absorbent member placed in the recording medium conveyance path, and the like) which occur when recording is made without any margin under the same condition as the condition under which recording is normally made, can be prevented or reduced.

In this specification, "reaction between a coloring agent and a microscopic particle" means the ionic bonding, physical and chemical adhesion, absorption, adhesion, and other interaction, between the two (coloring agent and microscopic particle), in addition to the covalent bonding between the two. A sample expression "reaction" includes the "reaction between ink and liquid composition", "reaction between anionic ink and cationic ink" and "reaction between ink containing polyvalent metallic cations and another type of ink", in addition to the "reaction between a coloring agent and a microscopic particle". Here, the "reaction between ink and liquid composition", "reaction between anionic ink and cationic ink", and "reaction between ink containing polyvalent metallic cations and another type of ink" means that the mixing of the two results in the interaction between the two, which improves waterproofness, color development, and the like, in other words, makes the properties of an image formed by ink superior to an image formed without using the reaction system.

Further, in this specification, "cationic ink or anionic ink" are defined as follows. That is, it is well known in the technical field related to the present invention that in terms of ionic properties of ink, ink itself is not charged, but is neutral. Here, anionic ink or cationic ink designates ink in which one of the ink components, for example, the coloring agent, has anionic radicals or cationic radicals, and which is adjusted so that these radicals behave as anionic radicals or cationic radicals in the ink. When the terms "anionic or cationic" are applied to liquid composition, their meanings are the same as those meant when they are applied to ink.

Also in this specification, the "borderless recording" means recording without margin along at least one of the edges of the recording surface of a recording medium. It means a recording method in which a recording region is the same or greater in size than a recording medium, as shown in FIG. 16(*a*), for example. As is evident from the drawing, in FIG. 16(*a*), recording was made with no margin along any of the four edges of the recording surface of the recording medium (full surface recording). The "borderless recording" also means a recording method in which a recording region is the same or greater in size, in terms of the vertical direction, than a recording medium, as shown in FIG. 16(*b*). As is evident from the drawing, in FIG. 16(*b*), recording was made without any margin along the two edges of the recording surface of the recording medium. As described above, in this specification, a recording is defined as "borderless recording", as long as the recording is made without margin along any of the edges of a recording medium (for example, top, bottom, left, or right edge). Incidentally, in FIG. 16, the hatched regions represent the recording regions. The "borderless recording", such as in the examples described above, is frequently used for recording a photographic image or the like. The "borderless recording" is sometimes referred to as "brim-less recording".

Further, in this specification, "bordered recording" means a recording method with the provision of margins along all the edges of the recording surface of a recording medium, with an image being surrounded by margins or borders, in other words, a recording method in which a strip of unrecorded area is left along each of the four edges of the recording medium, as shown in FIG. 16(*c*). The "bordered recording" such as described above is frequently used for recording a document image or the like; normally, recording is made using this method. Incidentally, sometimes the "bordered recording" is referred to as "normal recording" or "brimmed recording".

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (Inkjet Recording Apparatus)

First, an inkjet recording apparatus to which the present invention is applicable will be described regarding its general structure. An inkjet recording apparatus in accordance with the present invention records an image using a first recording unit (printing cartridge) and a second recording unit (reactive liquid cartridge). The first recording unit comprises an ink holding portion (ink container) which holds an ink subset, which will be described later, and an ink ejecting portion (ink ejection head) for ejecting the ink subset. The second recording unit comprises a liquid holding portion (reactive liquid container) for holding such liquid that is reactive to the ink subset; and a liquid ejecting portion (reactive liquid ejecting head) for ejecting the liquid (reactive liquid).

Figure 1:
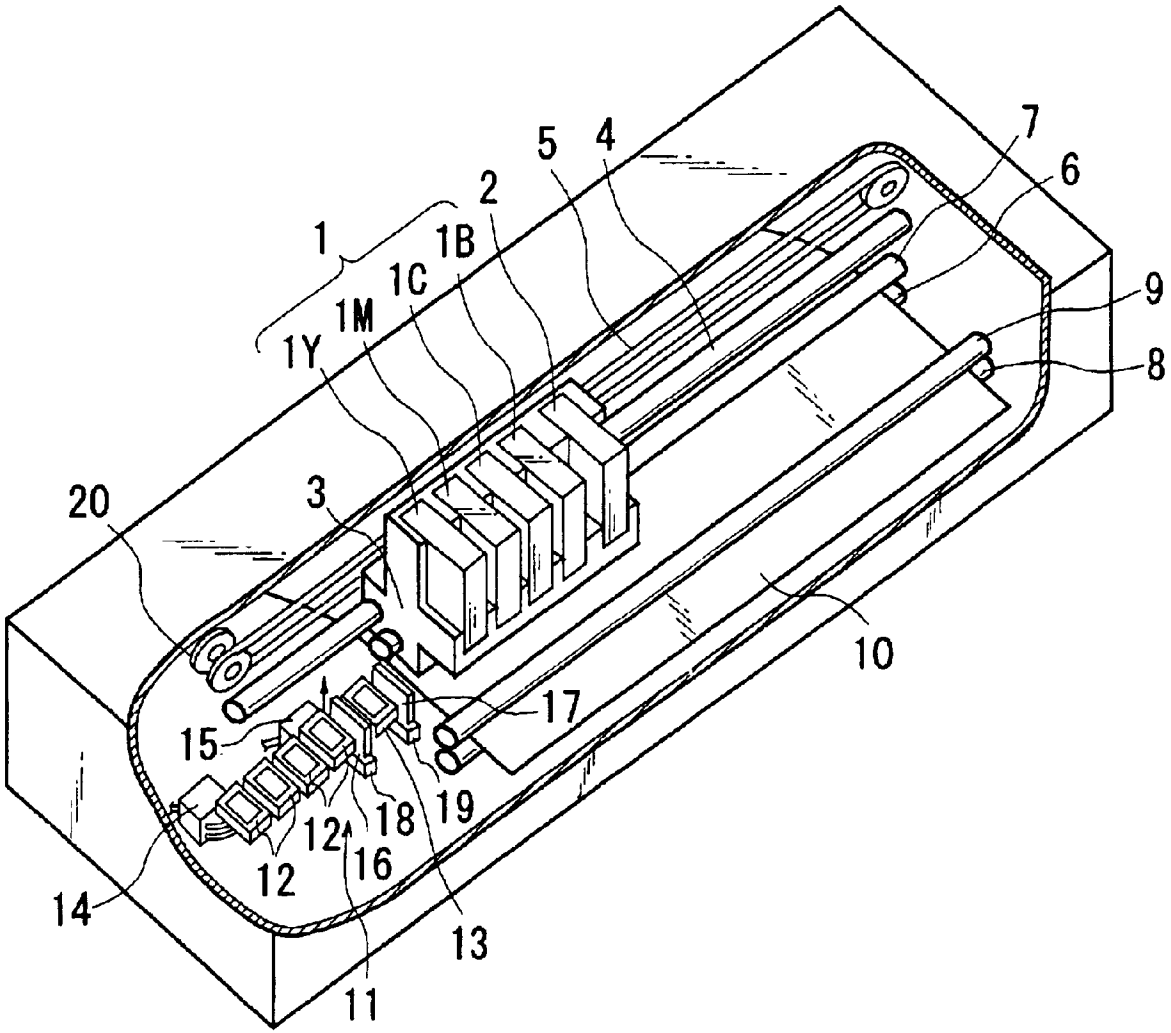
FIG. 1 is a schematic perspective view of an inkjet printing apparatus in accordance with the present invention.

FIG. 1 is a schematic perspective view of an example of an inkjet recording apparatus in accordance with the present invention, for showing the general structure thereof In FIG. 1, reference numeral 1 represents a printing cartridge for ejecting ink to print an image, and reference numeral 2 represents a reactive liquid cartridge for ejecting reactive liquid. The drawing shows an inkjet recording apparatus which employs four printing cartridges 1 different in the color of the inks they eject, and one reactive liquid cartridge 2.

Each printing cartridge 1 comprises an ink containing portion (ink container) as the top portion, and an ink ejecting portion (ink ejecting head) as the bottom portion. The reactive liquid cartridge 2 comprises a reactive liquid containing portion (reactive liquid container) as the top portion, and a reactive liquid ejecting portion (liquid ejecting portion) as the bottom portion. These cartridges 1 and 2 are provided with a connector for receiving driving signals or the like. Designated by reference numeral 3 is a carriage.

On the carriage 3, four printing head cartridges 1 different in the color of the ink they eject, and one reactive liquid cartridge 2, are mounted in the predetermined positional relationship relative to the carriage 3. The carriage 3 is provided with a connector holder for transmitting the signals for driving the ink ejecting portion of each printing cartridge 1 and the liquid ejecting portion of the reactive liquid cartridge 2. The carriage 3 and each of the cartridges 1 and 2 are electrically connected through this connector holder.

Each ink ejecting portion 1 ejects an ink different in color from the inks ejected from the other ink ejecting portions 1. The ink colors are yellow (Y), magenta (M), cyan (C), and black (B), for example. In FIG. 1, the printing cartridges 1Y, 1M, 1C and 1B, which eject yellow, magenta, cyan, and black inks, respectively, are mounted on the carriage 3, in the listed order from the left. The reactive liquid cartridge 2 for ejecting the reactive liquid is mounted to the right of the group of the printing cartridges.

Also in FIG. 1, reference numeral 4 represents a rail which slidably supports the carriage 3. The rail 4 extends in the primary scanning direction of the carriage 3. Reference numeral 5 represents a driving belt for transmitting the force for reciprocally driving the carriage 3 on the rail 4. Reference numerals 6, 7, 8 and 9 each represent conveyance rollers, which are positioned in a pair on the upstream and downstream sides of the printing station in terms of the recording medium conveyance direction in order to convey, while pinching, a recording medium 10. In order to keep flat the printing surface of the recording medium 9, for example, a piece of paper, the recording medium 9 is held against a platen (unshown) while it is conveyed through the printing station, being guided by the platen. The cartridges 1 and 2 are mounted on the carriage 3 so that their surfaces, in which ejection orifices are present, face the recording medium 10; more specifically, they are positioned below the bottom surface of the carriage 3, and between the recording medium conveyance rollers 7 and 9, in parallel to the recording medium 10 guided by the platen (unshown) while being pressed against the platen.

The inkjet printing apparatus is provided with a recovery unit 11, which is disposed near the home position established on the left side, outside the printing range. The recovery unit 1 has four caps 12 corresponding to the four printing cartridges (ink ejecting portions) 1Y, 1M, 1C and 1B, one for one, and a cap 13 corresponding to the reactive liquid cartridge (liquid ejecting portion). The caps 12 and 13 are enabled to move vertically. When the carriage 3 is in the home position, the caps 12 and 13 are kept pressed upon the ejection orifice surfaces of the corresponding cartridges 1 and 2, in order to keep the ejection orifices of the cartridges 1 and 2 sealed (capped). Capping prevents the solvent portion of ink within the ejection orifices from evaporating, preventing therefore the ink from increasing in viscosity or solidifying in the ejection orifices, which in turn contributes to the prevention of unsatisfactory ink ejection.

The recovery unit 11 also has a suction pump 14 connected to each of the caps 12, and a suction pump 15 connected to the cap 13. These pumps 14 and 15 are used for a cartridge performance recovery operation, which is carried out when the ink ejecting portions or reactive liquid ejecting portion fail to properly eject ink and reactive liquid, respectively, and in which the surfaces having the ejection orifices are capped with the caps 12 and 13 for suctioning. Further, the recovery unit 11 is provided with two wiping members 16 and 17 (blades), which are formed of an elastic substance such as rubber. The blades 16 and 17 are held by blade holders 18 and 19, respectively.

Referring to FIG. 1, which roughly depicts the present invention, the blade holders 18 and 19 are enabled to be moved up and down by a blade elevator (unshown) driven by the movement of the carriage 3. As the blade holders 18 and 19 are moved up or down, the blades 16 and 17 move up or down between an up position (wiping position) where they wipe away the ink and foreign substances adhering to the surfaces having the ejection orifices, and a down position (standby position) where they retreat and do not make contact with the surfaces having the ejection orifices. In the case of this embodiment, the blade elevator is structured so that the blade 16 for wiping the ejection orifice surfaces of the print cartridges 1 and the blade 17 for wiping the ejection orifice surface of the reactive liquid cartridge 2 are moved up and down independently from each other.

The blades 16 and 17 make contact with the ejection orifice surface of each printing cartridge 1 and the ejection orifice surface of the reactive liquid cartridge 2, respectively, wiping the surfaces as the blades and surfaces move relative to each other, when the carriage 3 is moved from the right side (printing range) in FIG. 1, to the home position, or when it moves from the home position to the printing range.

Figure 2:
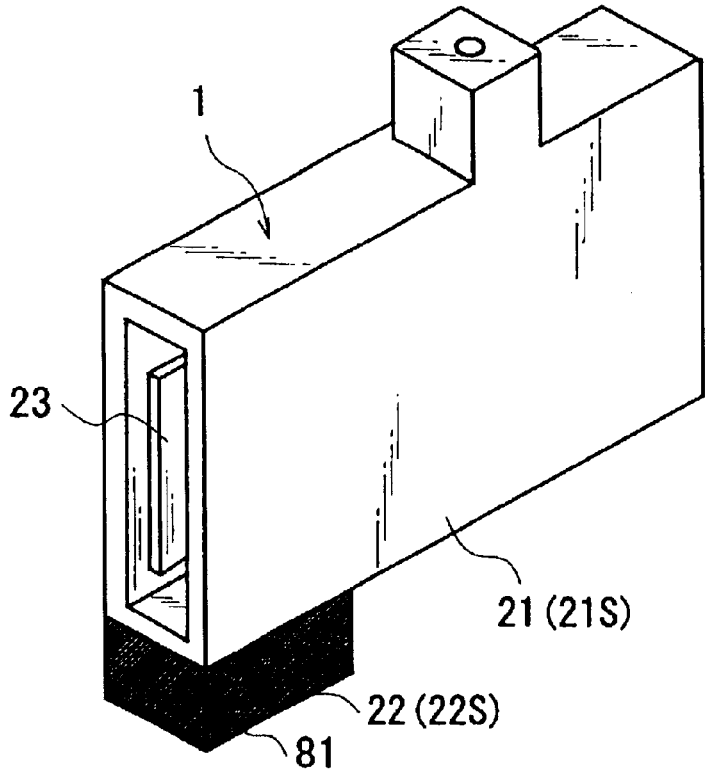
FIG. 2 is a schematic perspective view of a cartridge in FIG. 1.

FIG. 2 is a schematic perspective view of the printing cartridge 1 having an ink ejecting portion and an ink container. In the case of this cartridge, the ink ejecting portion and ink container are integral. The reactive liquid cartridge 2 is virtually the same in structure as the printing cartridge 1, except for the fact that the liquid it contains and ejects is not ink, but reactive liquid. In FIG. 2, the printing cartridge 1 comprises an ink container portion 21 as a top portion, and an ink ejecting portion 22 (ink ejecting head portion) as a bottom portion. It also comprises a connector 23 through which signals for driving the ink ejecting portion 22, or the like, are received, and ink remainder detection signals are outputted. The connector 23 is positioned next to the ink container portion 21.

The ink ejecting portion 22 on the bottom side in FIG. 2 (on the recording medium side) has an ejection surface 81 having a plurality of ejection orifices. In each of the liquid paths leading to the corresponding ejection orifices, an ejection energy generation element for generating the energy necessary for ejecting ink is disposed.

The printing cartridge 1 constitutes a printing means which ejects ink for printing. It has the ink ejecting portion 22 and ink containing portion 21, and is structured so that it can be exchanged. The ink ejecting portion 22 and ink containing portion 21 are integral. The ink ejecting portion 22 constitutes a printing head for ejecting ink with the use of thermal energy, and is equipped with electrothermal transducers for generating thermal energy. In the ink ejecting portion 22, bubbles are generated in the ink therein, in the so-called film boiling fashion, by the thermal energy applied to the ink by the electrothermal transducer. As a result, a portion of the ink is ejected from the ejection orifices onto the recording medium due to the pressure changes caused by the growth and contraction of the bubbles, creating an image on the recording medium.

Figure 3:
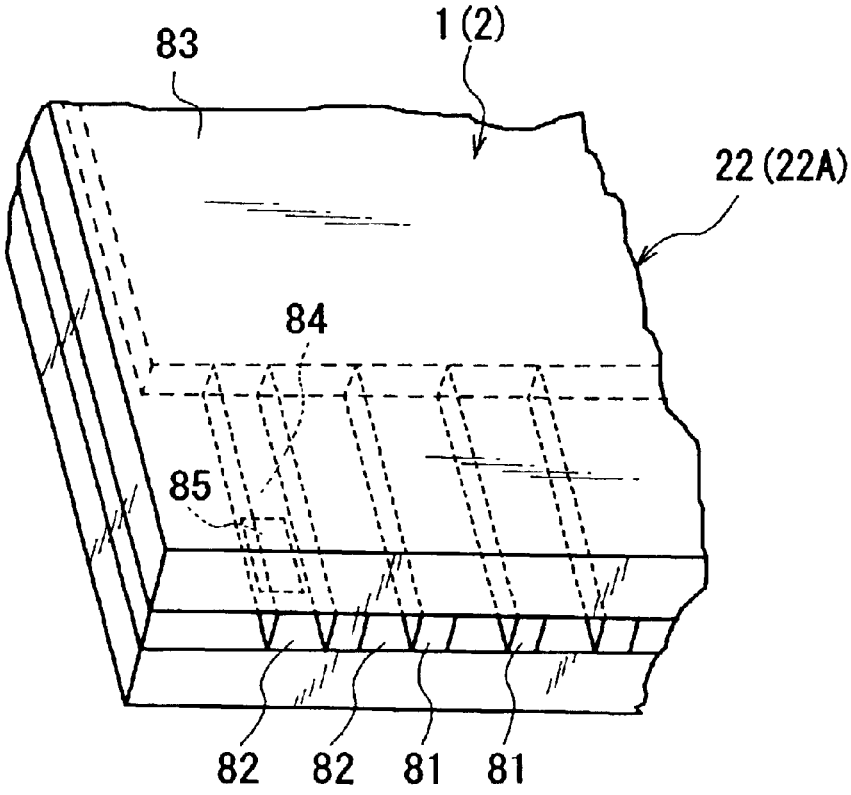
FIG. 3 is a schematic perspective view of the ink ejecting portion of the cartridge in FIG. 2, for showing the structure thereof.

Referring to FIG. 3, which is a schematic perspective view of the ink ejecting portion 22 (liquid ejecting portion 22A), and shows the structures thereof, the ejection surface 81 faces the recording medium 10 (printing paper or the like) with the presence of a predetermined gap (for example, approximately 0.5–2.0 mm), and is provided with a plurality of ejection orifices 82 arranged at a predetermined pitch. Each orifice 82 is connected to a common liquid chamber 83 by a liquid path 84. In each liquid path 84, an electrothermal transducer 85 (heat generating resistor or the like) for generating the ink ejection energy is disposed along the wall. The plurality of ejection orifices 82 are aligned in the direction perpendicular to the moving direction (primary scanning direction) of the printing cartridge 1. In the ink ejecting portion 22 structured as described above, the electrothermal transducers are driven (provided with power) by the corresponding image formation signals or ejection signals, to cause the ink in the liquid paths 84 to boil in the film boiling fashion, in order to eject ink from the ejection orifices 82 by the pressure generated by the boiling of the ink.

In the description of this embodiment given above, the present invention was described with reference to an inkjet recording apparatus employing an ink ejecting method in which ink or liquid (reactive liquid) is ejected by the application of thermal energy to the ink or liquid. However, the application of the present invention is not limited to the above-described ejection method. For example, the present invention is also applicable to an inkjet recording apparatus employing a piezoelectric type ink ejecting method which uses piezoelectric elements.

(Internal Structure of Inkjet Recording Apparatus and Mechanism of Adhesion of Chemical Compounds to Reverse Side of Recording Medium)

In the preceding description of the present invention, the inventors of the present invention mentioned, as a technical problem, the problem that when recording an image on the recording medium without leaving any margin (borderless recording) using a reaction system, chemical compounds adhere to the interior of the inkjet recording apparatus and the reverse side of the recording medium, contaminating the apparatus interior and the reverse side of the recording medium. The following theory regarding the mechanism of the chemical compounds adhesion was formed by the inventors of the present invention. This theory will be described next with reference to FIGS. 5 and 6.

Figure 5:
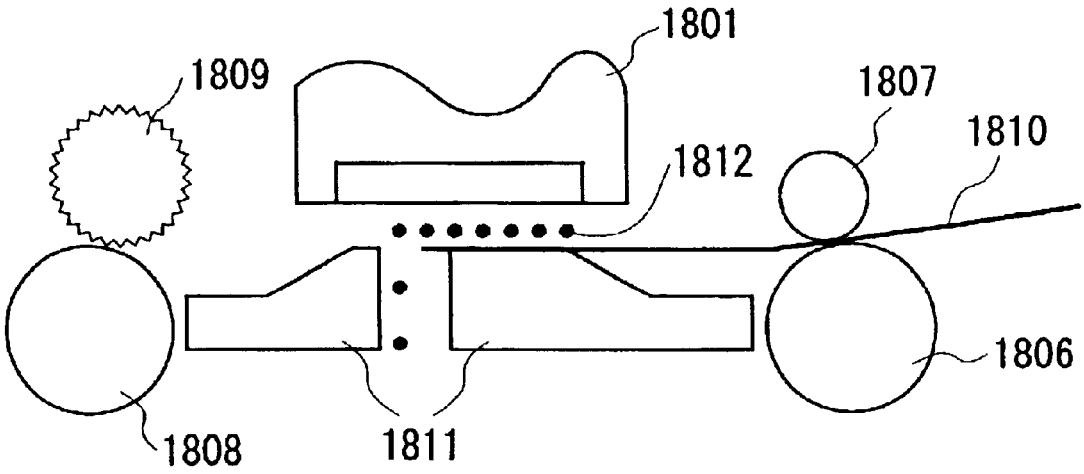
FIG. 5 is a schematic drawing for depicting one of the borderless (brim-less, margin-less) recording methods, that is, the methods for recording an image without leaving any margin.

FIG. 5 is a schematic drawing for showing how an image is formed at the leading edge of the recording medium 1810, more specifically, how an image is formed in the borderless mode, or "without leaving any margin", by the inkjet recording apparatus shown in FIG. 1, which uses a reaction system.

Figure 6:
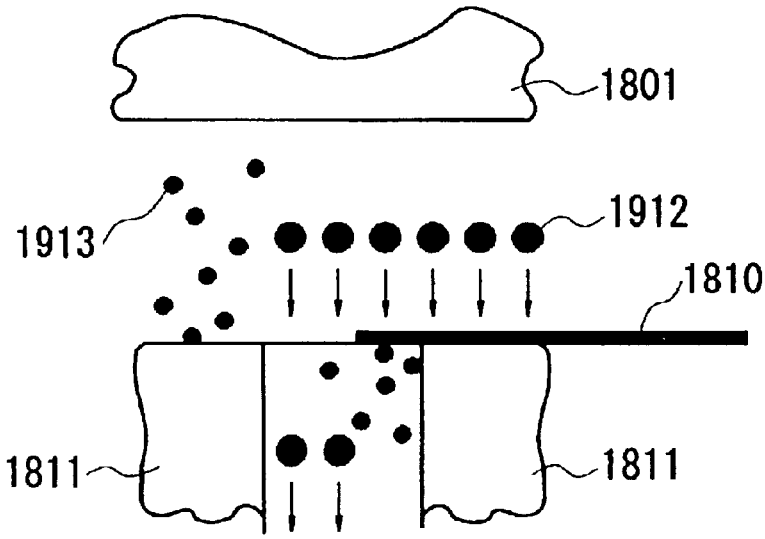
FIG. 6 is an enlarged schematic drawing of the recording medium edge in FIG. 5, from which recording is started, and its adjacencies.

Here, the component designated by reference numeral 1801 corresponds to the cartridges 1 and 2 in FIG. 1, and those designated by reference numerals 1806, 1807, 1808 and 1809 correspond to the pair of conveyance rollers 6 and 7, and the pair of conveyance rollers 8 and 9 in FIG. 1. The component 1811 corresponds to the unshown platen in FIG. 1. Reference numeral 1812 represents the ink or reactive liquid of the reaction system ejected from the cartridge 1801. FIG. 6 is an enlarged schematic view of the edge region of the recording medium 1810 in FIG. 5, and its adjacencies. The elements and the portions thereof in FIG. 6 designated by the same reference numerals as the reference numerals used in FIG. 5 are identical to those in FIG. 5. As liquid droplets are ejected from the cartridge 1801, the primary droplets 1912 fly in the direction indicated by the arrow marks. Sometimes, secondary particles 1913, which form ink mist, are generated during the liquid ejection. It is possible to think that the mist forming particles 1913 generate due to the following reasons: the splitting of the primary droplets during their flight, or landing on the recording medium 1810, and/or the collision between a primary droplet and another primary droplet which has landed on the recording medium, but has not completed the fixation process. When an image is recorded using ink and reactive liquid, ink mist and reactive liquid mist are generated during the ejection and flight of ink and reactive liquid droplets, and also during their landing on the recording medium, and both mists float in the air. Some of the mist forming reactive liquid particles land on the platen 1811 or recording medium 1810, and adhere thereto. If the mist-forming ink particles come into contact with the reactive liquid particles on the platen 1811 or recording medium 1810, that is, the mist-forming reactive liquid particles having landed on the platen 1811 or recording medium 1810, the former reacts with the latter, and the resultant chemical compounds adhere to the surface of the platen 1811 or recording medium 1810. The opposite is also true: the mist-forming ink particles first adhere to the platen 1811 or recording medium 1810, and then, the mist-forming reactive liquid particles come into contact with the mist-forming ink particles adhering to the platen 1811 or recording medium 1810, and react therewith, leaving the resultant chemical compounds adhering to the platen 1811 or recording medium 1810. Further, sometimes the mist-forming ink particles and mist-forming reactive liquid particles collide in midair, and the particles of the resultant chemical compounds land on the platen 1811 or recording medium 1810, adhering thereto. It is also possible that the mist-forming ink particles or mist forming reactive liquid particles sometimes come into contact with the above-described chemical compounds on the platen 1811 or recording medium 1810, and enlarge the compound particles. As will be evident from the above explanation, the generation of ink mist or reactive liquid mist increases the possibility that the platen surface or the reverse side of the recording medium will be contaminated by the chemical compounds resulting from the reaction between the ink and reactive liquid. Further, sometimes the recording medium becomes contaminated across its reverse side as it is conveyed on the platen to which the chemical compounds have adhered. On the contrary, sometimes the contaminants, that is, the chemical compounds resulting from the reaction between the ink and reactive liquid, on a recording medium, are transferred onto the platen, contaminating the platen, while the recording medium is conveyed on the platen. This phenomenon that the platen surface or the reverse side of the recording medium is contaminated by the chemical compounds resulting from the reaction between the mist-forming ink particles and mist-forming reactive liquid particles is such a phenomenon that is particularly conspicuous during "borderless recording", that is, when it is necessary to eject ink onto the edge of the recording medium, as well as slightly outward of the edge with respect to the recording medium. However, when producing a print with margins, or during "normal recording", it is not blatantly conspicuous, being even inconspicuous, and therefore, does not create a problem.

Another technical problem is that the absorbent member disposed in the conveyance path (absorbent member placed in the hole of the platen) declines in absorbency. The reason for this decline will be described next with reference to FIGS. 5 and 6.

When recording without leaving any margin, ink droplets are ejected slightly outward of the edge of a recording medium, as well as onto the edge, as shown in FIGS. 5 and 6, for the purpose of ensuring that ink droplets land at the edge of the recording medium. These ink droplets ejected slightly outward of the recording medium edge are absorbed by the absorbent member in the hole of the platen. During the borderless recording, reactive liquid is ejected along with ink. Therefore, unless some kind of measure is taken, not only is ink ejected slightly outward of the edge of the recording medium, but also is reactive liquid. As a result, both ink and reactive liquid are absorbed by the absorbent member, and react with each other in the absorbent member, producing chemical compounds, which deteriorate the liquid absorbing performance of the absorbent member. This deterioration of the liquid absorbing performance of the absorbent member is a problem which occurs only when both ink and reactive liquid are ejected toward the edge of the recording medium as well as slightly outward of the edge with respect to the recording medium as shown in FIG. 6. In other words, it is a problem which rarely occurs during the normal recording mode (recording mode with margins) in which neither ink nor reactive liquid is ejected onto, or outward of, the edge of the recording medium.

The inventors of the present invention discovered that in order to prevent or reduce the contamination by the above-described chemical compounds, it is necessary to prevent the formation of the mist, that is, the cause of the generation of the contaminating chemical compounds, or to reduce the amount by which the mist is formed, and also that in order to prevent the deterioration of the absorbing performance of the absorbent member disposed in the recording medium path, or to reduce the amount by which the absorbing performance of the absorbent member is deteriorated, it is necessary either to eject no reactive liquid onto, or outward of, the edge of the recording medium, or to reduce the amount by which reactive liquid is ejected onto, or outward of, the edge of the recording medium. Further, the inventors of the present invention recognized that when recording an image on a recording medium without leaving any margin (when recording in the borderless-less mode), it is necessary to employ a recording method in which the amount by which the mist is generated, and the amount by which the absorbing performance of the absorbent member is deteriorated, are as small as possible. Thus, they created the recording operation flow chart shown in FIG. 7, in which the manner in which an image is recorded in the borderless mode is made different from the manner in which an image is recorded in the normal mode.

(Flow of Borderless Recording Operation)

Figure 7:
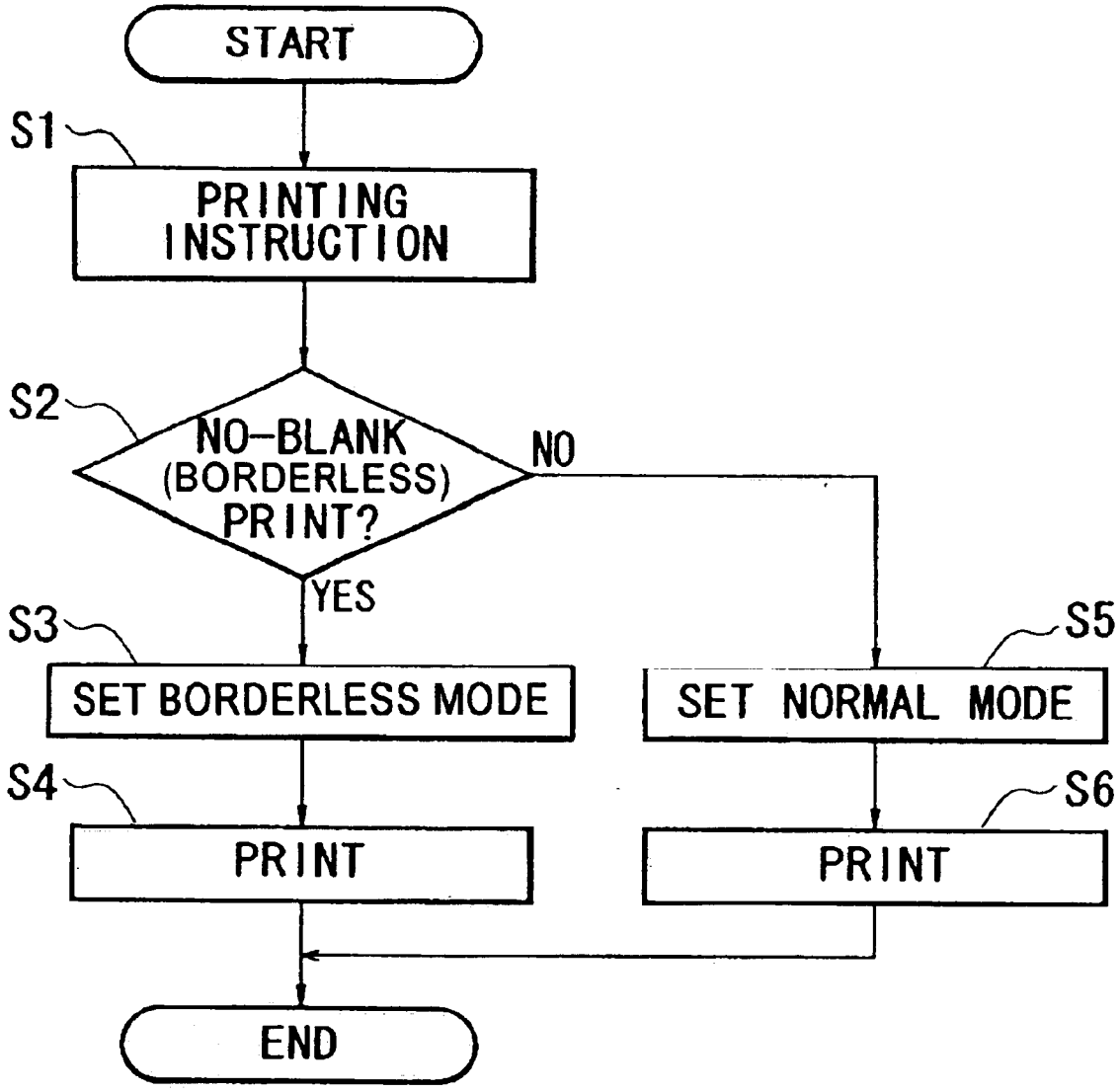
FIG. 7 is a flow chart showing the recording operation of an inkjet recording apparatus in accordance with the present invention.

FIG. 7 is a flowchart which shows the steps followed by the inkjet recording apparatus in this embodiment during a recording operation. In this embodiment, when recording an image, either a first recording mode in which recording is made without leaving any margin, or a second recording mode in which recording is normally made, that is, with the provision of margins, is selected, and the image is formed in the selected mode.

Referring to FIG. 7, first, in Step S1, a recording command is given to the recording apparatus. Next, in Step S2, it is detected (determined) by a detecting means (determining means) whether the recording operation is carried out in borderless mode or normal mode. The detecting (determining) method used by the detecting means (determining means) will be described later in detail. If it is detected (determined) in Step S2 that the recording operation is to be carried out in the borderless mode, the borderless recording mode is set in Step S3. Here, "setting the borderless recording mode" means the preparation of data (for example, ink ejection data and reactive liquid ejection data) necessary for carrying out a recording operation in the borderless mode. After the borderless mode is set in Step S3, an image is recorded on a recording medium without leaving any margin, in Step S4. On the other hand, if it is detected (determined) in Step S2 that an image is not recorded in the borderless mode, in other words, an image is recorded in the normal mode, that is, with the provision of margins, the normal recording mode, or the mode with the provision of margins, is set in Step S5. In this case, the data (for example, ink ejection data and reactive liquid ejection data) necessary for recording an image in the normal recording mode are prepared. Thereafter, an image is recorded on a recording medium in the normal recording mode, in Step S6.

As described above, according to the present invention, the ejection mode used for recording with no margin (when carrying out the first recording operation) is made different from the ejection mode used for recording with the provision of a margin along each edge of a recording medium (when carrying out the normal recording operation, that is, the second recording operation), making it possible to select an optimal recording mode depending on the manner, in terms of the margin setup, in which an image is recorded on a recording medium. More specifically, the borderless recording mode is made different from the normal recording mode, in the following conditions: number of times each section of recording medium is scanned by the ink ejecting portion and reactive liquid ejecting portion; the ratio at which scanning lines are thinned for ink and reactive liquid; the volume of each ink droplet and the volume of each reactive liquid droplet; and the like. Next, the borderless recording mode and normal recording mode will be described.

(Borderless Recording Mode)

As described above, when recording with no margin, not only must ink be ejected onto the edges of a recording medium, but also slightly outward of the recording medium with respect to the recording medium, in order to ensure that ink lands on the edges of the recording medium. Therefore, the chemical compounds resulting from the contact between the ink mist and reactive liquid mist are likely to adhere to the platen or the reverse side of the recording medium. Thus, in the borderless recording mode, ink and reactive liquid (liquid reactants) are ejected using a method capable of preventing mist generation, or a method capable of reducing the amount by which mist is generated. As for such methods, it is possible to list the following six methods (i)–(vi). These methods may be individually employed or employed in combination.

(i) Split Recording (Multi-pass Recording; Multiscan Recording)

Figure 14:
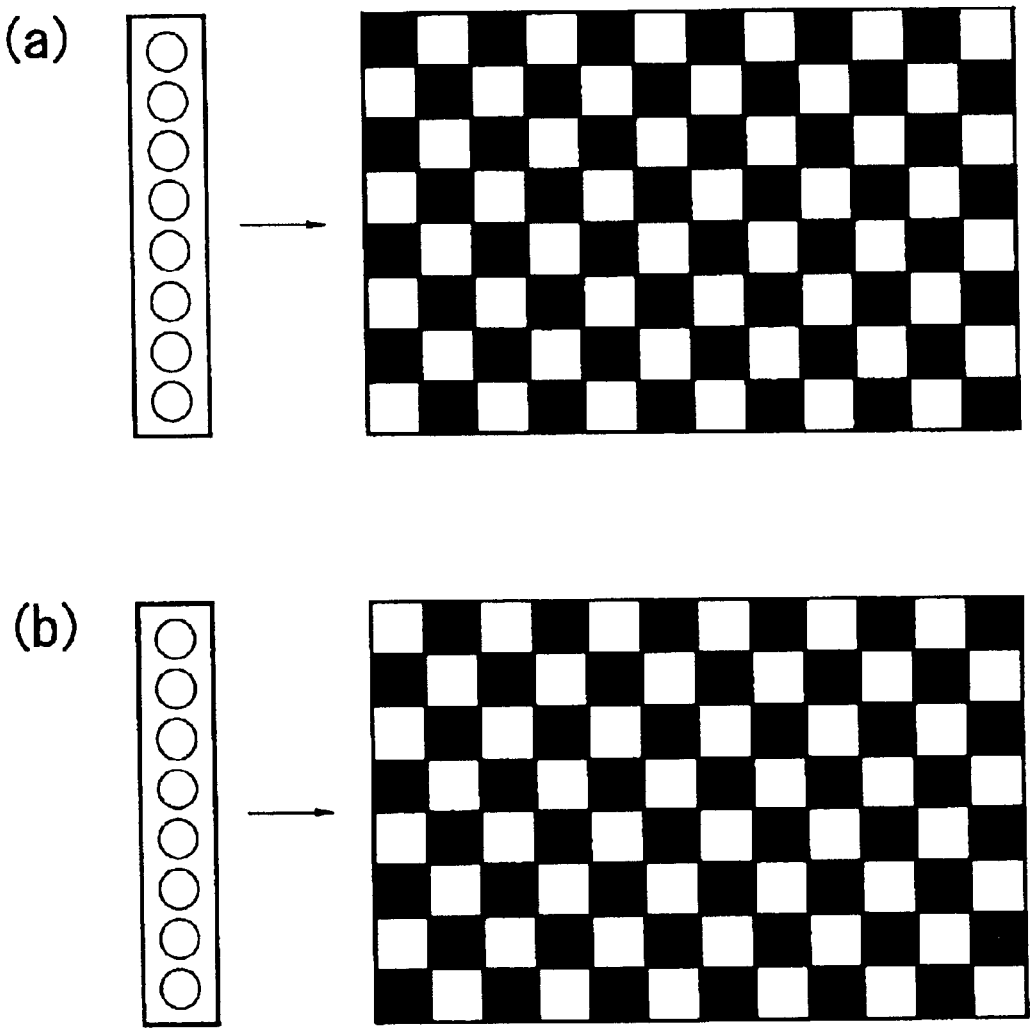
FIG. 14 is a drawing for depicting a split (multi-pass; multiscan) recording method in which an image is formed on a recording medium by scanning the recording area of the recording medium twice or more.

Sections (a) and (b) of FIG. 14 are drawings for showing an example of a split recording method, in which a given portion of a recording medium is scanned two or more times by the ink ejecting portion and reactive liquid ejecting portion, in order to complete the portion of an image corresponding to this portion of the recording medium. Here, for the simplification of description, it is assumed that each head for ejecting a reaction system (for example, reaction systems 1–3 which will be described later) is provided with eight ejection orifices, and that an image is composed of 96 dots 8×12 (vertical×horizontal) grid). FIG. 14 shows a case in which a given portion of a recording medium is scanned twice to complete the portion of an image corresponding to the given portion of the recording medium. In other words, during the first scanning, half of the total picture elements are recorded, and during the second scanning, the remaining half of the picture elements are recorded. More specifically, this split (multiscan) recording method is set up so that during the first scanning, the picture elements corresponding to the black squares in (a) of FIG. 14 are recordable, and that when there are ejection data for a given picture element belonging to the group of black squares in (a) of FIG. 14, a reaction system (at least one of the reactants, that is, the ink or the reactive liquid, of the reaction system) is ejected to form a dot on the recording medium. Further, this split (multiscan) recording method is set up so that during the second scanning, the picture elements corresponding to the black squares in (b) of FIG. 14 are recordable, and that the reaction system is ejected in the same manner as during the first scanning, to form a dot containing both ink and reactive liquid. Here, "both ink and reactive liquid" means "combination of ink and liquid composition", "combination of cationic ink and anioic ink", or "combination of ink containing polyvalent metallic cations and another type of ink".

As described above, employing the split (multiscan) recording method in which a given portion of an image is completed by scanning the portion of a recording medium corresponding to the given portion of the image reduces the amount by which ink and reactive liquid are ejected per scanning, reducing, therefore, the amounts by which ink mist and reactive liquid mist are generated. Further, it is reasonable to think that when the split (multiscan) recording method is used, the ink droplets and reactive liquid droplets applied to the portion of the recording medium corresponding to a given cell of the aforementioned grid pattern, during the first scanning, will have permeated the recording medium by a substantial amount by the time the ink droplets and reactive liquid droplets will be applied to the portion of the recording medium corresponding to the next cell of the aforementioned grid pattern during the second scanning. Therefore, the amount by which mist is generated through the contact between the ink droplets and reactive liquid droplets ejected during the first scanning, and those ejected during the second scanning, will be smaller, compared to the amount by which mist is generated through the contact between the ink droplets and reactive liquid droplets applied to the portion of the recording medium corresponding to a given cell of the aforementioned grid pattern, and those applied to the portion of the recording medium corresponding to the next cell, during the normal recording mode, because the interval between when an ink droplet and a reactive liquid droplet are applied to the portion of the recording medium corresponding to a given cell of the aforementioned grid pattern, and when another ink droplet and another reactive liquid droplet are applied to the portion of the recording medium corresponding to the next cell, during the normal recording mode, is shorter than that during the borderless recording mode. Therefore, the amount of the unwanted chemical compounds resulting from the contact between the ink mist and reactive liquid mist is smaller; the amount of the unwanted chemical compounds which adhere to the platen or the reverse side of the recording medium is smaller. In other words, selecting the split (multiscan) recording method when an inkjet recording apparatus is in the borderless recording mode reduces the amount of contamination traceable to the selection of the borderless recording mode.

In the case of the above-described example of the split (multiscan) recording method, it was set up so that during the first scanning, the reaction system was ejected corresponding to the picture elements corresponding to the black squares of the checkerboard pattern shown in (a) of FIG. 14, and during the second scanning, the reaction system was ejected corresponding to the black squares of the checkerboard pattern shown in (b) of FIG. 14. However, the ejection pattern does not need to be limited to the above-described one. For example, the ejection pattern may be created in the following manner. First, picture elements for which recording data are present are selected among all the picture elements corresponding to a given section of an image, and are given an ordinal number. Then, in order to complete the given section of the image, the thus selected picture elements having an odd ordinal number, for example, the first, third, and fifth elements, and so on, are recorded during the first scanning, and the picture elements having an even ordinal number, for example, the second, fourth and sixth picture elements, and so on, are recorded during the second scanning. Further, the number of times the portion of a recording medium corresponding to a given portion of an image is scanned does not need to be limited to two. It has only to be twice or more, for example, three times, four times, eight times, and the like.

Figure 15:
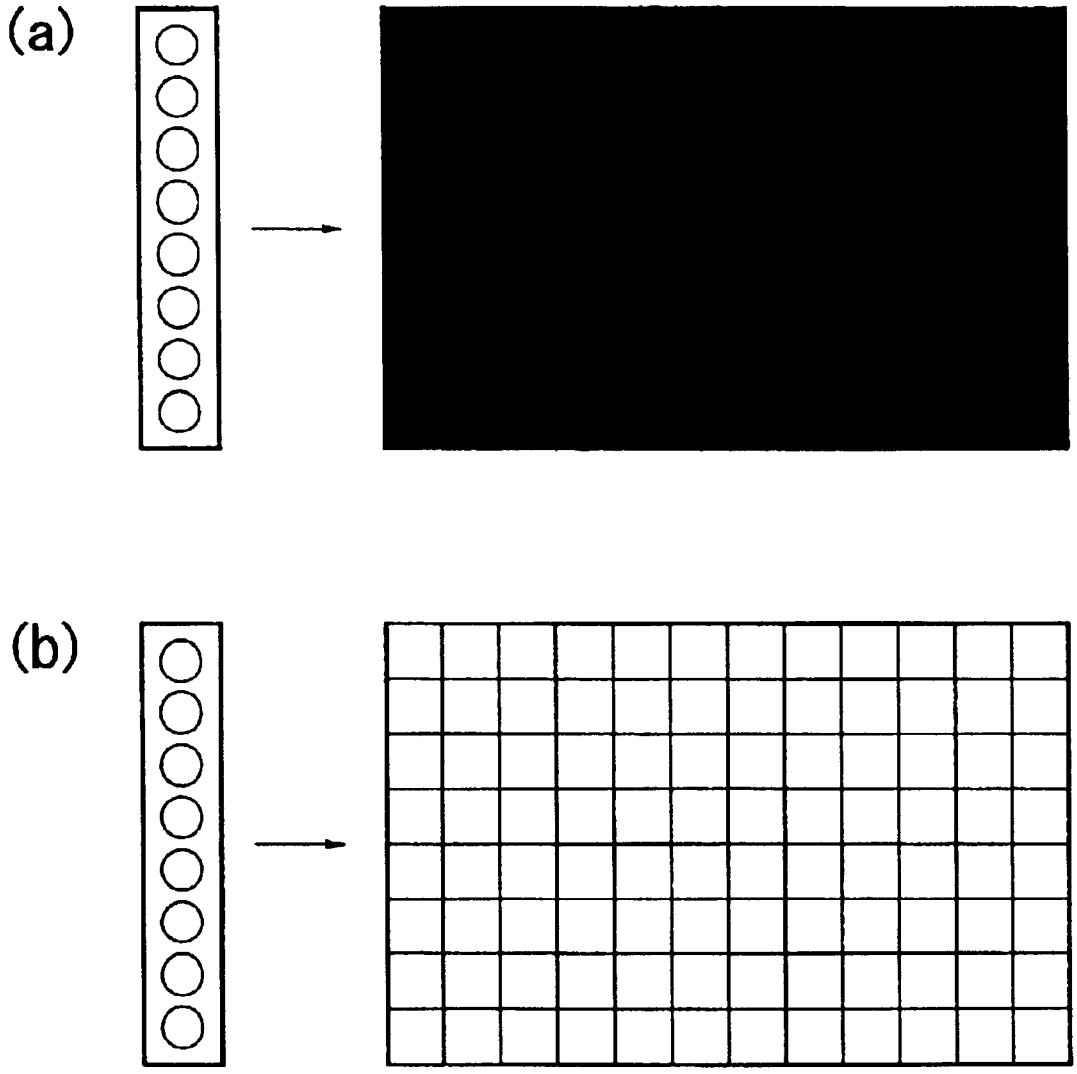
FIG. 15 is a drawing for depicting a single-pass recording method in which an image is recorded on a recording medium by scanning a given recording area of the recording medium only once.
Figure 16:
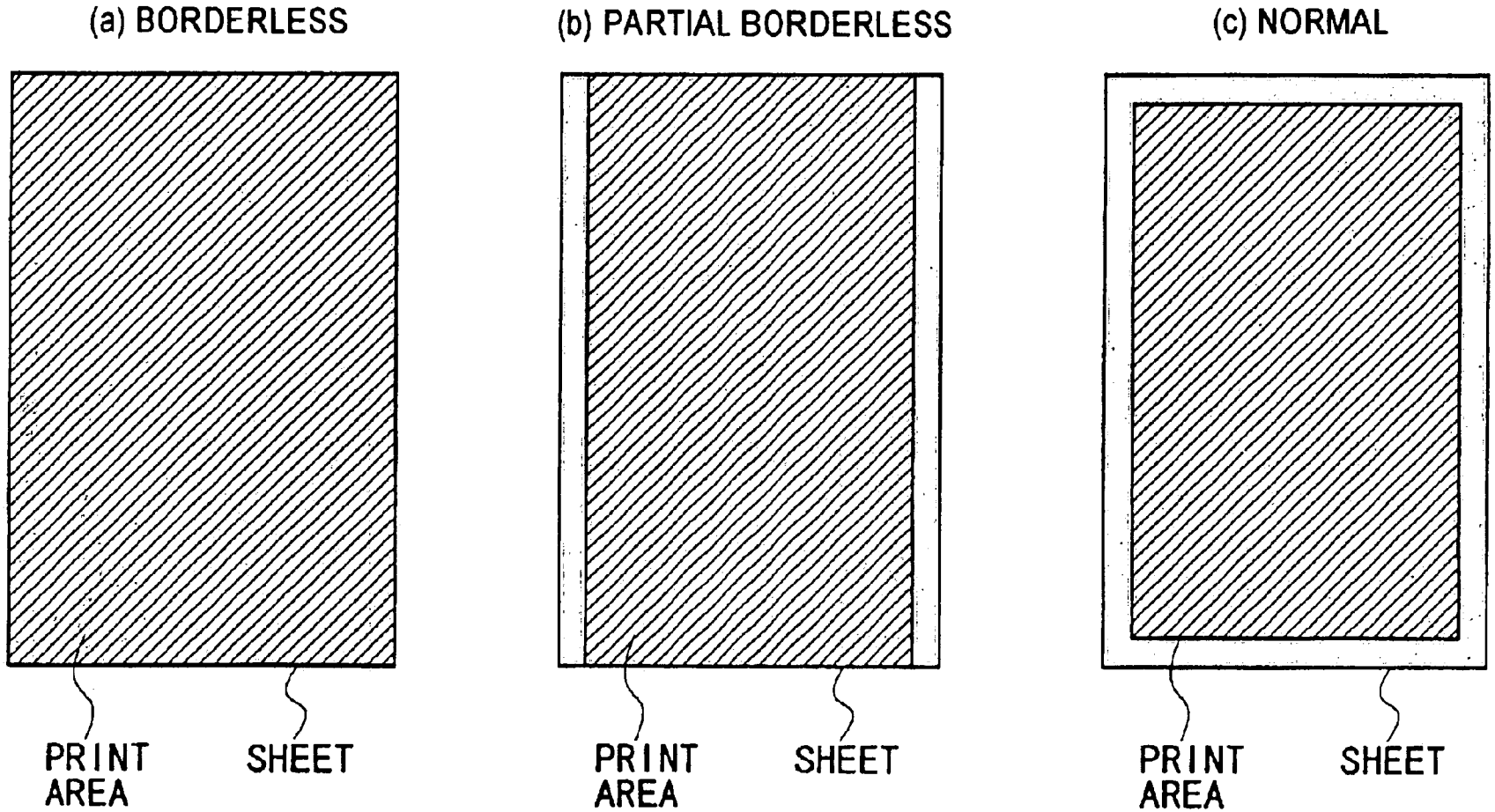
FIG. 16 is a drawing for showing the difference between an image with no margin and an image with margins (normal image).

(ii) Combination of Split (Multiscan) Recording Method and Single-pass Recording Method The single-pass recording method means a recording method in which a given portion of an image is completed by scanning only once the portion of a recording medium corresponding to the given portion of the image. Referring to (a) of FIG. 15, in the single-pass recording method, an inkjet recording apparatus is set up so that all the picture elements corresponding to a given portion of an image are recorded by scanning only once the portion of a recording medium corresponding to the given portion of the image. During the single scanning, ink and reactive liquid are ejected corresponding to each of the picture elements for which ejection data are present, forming dots on the recording medium.

The amount by which mist is formed can be reduced by the combined usage of this single-pass recording method and the aforementioned split (multiscan) recording method (i). For example, when using a combination of ink and liquid composition (reactive liquid), a structural arrangement is made so that ink is ejected using the split (multiscan) recording method, whereas liquid composition is ejected using the single-pass recording method. In other words, ink is ejected in accordance with the patterns shown in FIG. 14 using the split (multiscan) recording method (two passes or more), whereas liquid composition is ejected in accordance with the pattern shown in (a) of FIG. 15 using the singe-pass recording method during the first scanning. In the case of this recording method, liquid composition is not ejected during the second pass; in other words, the pattern in accordance with which liquid composition is ejected is the one shown in (b) of FIG. 15. This kind of structural arrangement reduces the amount by which mist is produced, reducing thereby the amount of the chemical compounds resulting from the interaction of ink mist and liquid composition mist, and ultimately reducing the amount of contamination which occurs when recording in the borderless mode. Incidentally, the structural arrangement may be opposite to the above-described one. That is, the structural arrangement can be such that liquid composition is ejected using the split (multiscan) recording method, whereas ink is ejected using the single-pass recording method. In this case, the amount by which liquid composition mist is produced is reduced, reducing thereby the amount of the chemical compounds resulting from the interaction of ink mist and liquid composition mist, and ultimately reducing the amount of contamination which occurs when recording in the borderless mode.

As is evident from the above, the amount of ink mist or liquid composition mist can be reduced by using the split (multiscan) recording method for either the ink ejecting operation or reactive liquid ejecting operation, and the single-pass recording method for the other.

(iii) Thinned Ejection Data Recording Method

The thinned ejection data recording method means a recording method in which the ejection data for at least one of the reactants (ink or reactive liquid) in a reaction system is thinned. For example, it is possible to make such a structural arrangement that when the combination of ink and liquid composition (reactive liquid) is used as the reaction system, liquid composition (reactive liquid) is not ejected, and only ink is ejected. According to this structural arrangement, liquid composition is not ejected at all, eliminating the generation of liquid composition mist, eliminating naturally the generation of the unwanted chemical compounds traceable to the interaction of ink mist and liquid composition, and ultimately preventing the contamination traceable to the chemical compounds. More specifically, the structural arrangement is such that the ejection data for liquid composition are thinned at a given ratio, whereas the ejection data for ink are not thinned, so that liquid composition is ejected corresponding to some of the picture elements recorded by ink ejection. According to this structural arrangement, the number of the cells of the aforementioned checkerboard pattern, corresponding to which liquid composition is ejected, is thinned at a certain ratio. Therefore, the amount by which liquid composition mist is produced, and the amount by which the ink mist is formed due to the contact between the liquid composition and ink, on the recording medium, is reduced, although the formation of such ink mist cannot be completely prevented. As a result, the contamination traceable to the aforementioned chemical compounds is reduced. Further, the structural arrangement may be such that not only is the number of cells of the aforementioned grid pattern, corresponding to which liquid composition is ejected, thinned, but also the number of the cells, corresponding to which ink is ejected, is thinned at a given ratio. According to this structural arrangement, not only is the amount of liquid composition mist reduced, but also the amount of ink mist is reduced, in comparison to the structural arrangement in which the thinning is done only for liquid composition. Therefore, the amount of the chemical compounds resulting from the interaction of ink mist and liquid composition mist is further reduced.

When the combination of cationic ink and anionic ink is used as the reaction system, for example, when cationic black ink (Bk) is used in combination with anionic color inks (Y, M and C), the structural arrangement may be such that recording is made by ejecting anionic color inks, without ejecting cationic black ink. According to the structural arrangement, cationic black ink is not ejected at all, and therefore, cationic black ink mist does not form. Naturally, the unwanted chemical compounds traceable to the anionic ink mist and cationic ink mist are not produced. Therefore, the contamination for which the unwanted chemical compounds are responsible does not occur. In this case, the structural arrangement is such that the black ink Bk is not ejected at all, and therefore, the picture elements intended to be recorded with the black ink Bk are to be recorded by the combination of yellow, magenta and cyan inks (Y, M and C). Instead of making the structural arrangement in which cationic black ink is not ejected at all, the amount by which cationic black ink is applied may be reduced by thinning the ejection data for the black ink at a certain ratio. Further, both the ejection data for cationic black ink and the ejection data for anionic color inks (Y, M and C) may be thinned at a certain ratio.

As described above, according to the thinned ejection data recording method in which the ejection data are thinned for ink and/or reactive liquids, the amounts, by which ink and reactive liquid are ejected, are reduced, reducing proportionally the amounts by which the ink mist and reactive liquid mist are formed. Accordingly, the unwanted chemical compounds traceable to interaction between ink mist and reactive liquid mist are not produced or are reduced in amount. Therefore, the amount of the unwanted chemical compounds which adhere to the platen and the reverse side of the recording medium is smaller. In other words, making a structural arrangement such that when an inkjet recording apparatus is in the borderless recording mode the thinned ejection data recording method is used, the amount of contamination resulting from the use of the borderless recording mode can be reduced.

(iv) Droplet Volume Reduction Recording Method

In the above-described recording method (iii), the amount by which ink mist and reactive liquid mist are formed is reduced by thinning the ejection data for ink and/or reactive liquid. In comparison, in this recording method, the amount by which ink mist and reactive liquid mist are formed is reduced by reducing the volume of a droplet, in the form of which ink and reactive liquid are ejected from ejection orifices. As for a method for reducing the volume of a droplet, in the form of which ink and reactive liquid are ejected from ejection orifices, there are a method in which a pre-pulse applied to the ejection energy generation element disposed in each nozzle is adjusted in width, a method in which the length of the interval time between a pre-heat pulse and main heat pulse is adjusted, a method in which driving voltage is adjusted, and the like. A pre-pulse is a pulse for controlling, essentially, the temperature of the ink in the liquid path, and plays an important role in controlling the droplet volume. It is desired that the pre-pulse width is set to a value at which no bubble is generated in the liquid by the thermal energy generated by the application of the pre-pulse. The interval time is the time for allowing the thermal energy generated by a pre-pulse to be transferred to the liquid in the liquid path. The main pulse is a pulse for ejecting liquid from an ejection orifice by generating a bubble in the liquid in the liquid path.

In this droplet volume reduction recording method, the volume of a droplet, in the form of which ink and reactive liquid are ejected, is reduced for ink and/or reactive liquid. More specifically, a structural arrangement is made so that when an inkjet recording apparatus is in the borderless mode, the volume of a droplet, in the form of which reactive liquid is ejected, is reduced compared to that in the normal mode. Instead of reducing the volume of a droplet, in the form of which reactive liquid is ejected, both the volume of a droplet, in the form of which reactive liquid is ejected, and the volume of a droplet, in the form of which ink is ejected, may be reduced. According to this structural arrangement, the amounts by which ink and reactive liquid are applied is reduced, reducing proportionally the amounts by which the ink mist and reactive liquid mist are formed when ink and reactive liquid droplets land and/or when they come into contact with the ink and reactive droplets having landed slightly earlier. Accordingly, the unwanted chemical compounds traceable to interaction between ink mist and reactive liquid mist are not produced or are reduced in amount. Therefore, the amount of the unwanted chemical compounds which adhere to the platen and the reverse side of the recording medium is smaller. In other words, using the droplet volume reduction recording method when an inkjet recording apparatus is in the borderless recording mode reduces the amount of contamination resulting from the use of the borderless recording mode.

(v) Recording Method in which Amount by which Ink and Reactive Liquid are Ejected upon Edge Portion of Recording Area is Reduced In the borderless recording mode, there is a possibility that if ink and reactive liquid are ejected, being aimed at the edge of a recording medium, and/or a point slightly outward of the edge, the ejected ink and reactive liquid also land on the platen. If the ejected ink and reactive liquid land on the platen, chemical compounds are formed on the platen due to the reaction between the ink and reactive liquid, soiling the platen. Thus, a structural arrangement is made so that when an inkjet recording apparatus is in the borderless recording mode, the amounts by which ink and reactive liquid are ejected at the edge region of a recording medium are made smaller than those at the rest of the recording medium. Instead, the amounts by which ink and reactive liquid are ejected slightly outward of the boundary of the recording medium may be made smaller than those at a point on the recording medium. Here, the edge region means the region of a recording medium next to the edge of the recording medium, having a predetermined width measured from the edge. When the predetermined width corresponds to a single dot, the width of the edge region measured from the edge equals the width of a single dot, whereas when the predetermined width corresponds to two dots, the width of the edge region is equal to the total of the widths of two dots. The width of the edge region may be optionally set on the basis of dot width.

To describe further, the structural arrangement may be such that when an image is recorded using an inkjet recording apparatus set to the borderless mode, at least one of the amount by which ink and reactive liquid are ejected onto the recording region (edge region) of a recording medium, having a predetermined width from the edge of the recording medium, and the amount by which ink and reactive liquid are ejected at the region slightly outward of the edge, is reduced, whereas the amount by which ink and reactive liquid are ejected onto the recording region of the recording medium other than the edge region is not reduced. In other words, at least one of the set of ink and reactive ejection data for the edge region and the set of the ink and reactive ejection data for the region slightly off the recording medium is thinned, or at least one among the volume of a droplet, in the form of which ink and reactive liquid are ejected from ejection orifices onto the edge region, the volume of a droplet, in the form of which ink is ejected onto the region off the recording medium, and the volume of a droplet in the form of which reactive liquid is ejected onto the region off the recording medium, is reduced. Further, control may executed so that reactive liquid is not ejected at the edge region and/or the region slightly off the recording medium. When control is executed not to eject reactive liquid at the region slightly off the recording medium, or at both the edge region of the recording medium and the region off the recording medium, the chemical compounds resulting from the interaction between the ink and reactive liquid do not adhere to the absorbent member (absorbent member in the hole of the platen) placed in the recording medium conveyance path, and therefore, the absorbent member does not deteriorate in absorbency. It should be noted here that when reactive liquid is not ejected at either the edge region of the recording medium or the region of the recording medium, or neither of them, the region of the recording medium onto which ink is ejected is different from the region of the recording medium onto which reactive liquid is ejected.

The target for the ejection data thinning, or the reduction of the volume of a droplet, in the form of which ejection is made from each ejection orifice, may be both ink and reactive liquid, or only reactive liquid.

Further, instead of thinning the ejection data, or reducing the volume of each droplet from each ejection orifice, only for the edge region, the ejection data thinning and the reduction of the volume of each droplet from each ejection orifice may be effected for the region off the recording medium as well as for the edge region. In the case of the latter, however, the ratio at which the ejection data are thinned for the edge region, and the ratio at which the volume of each droplet, in the form of which ink and reactive liquid are ejected, is reduced for the edge region are made greater than those for the regions other than the edge region.

As described above, according to the structural arrangement in which the data thinning ratio and ejection volume reduction ratio are made greater for the edge region of a recording medium than the regions of the recording medium other than the edge region, the amounts of ink and reactive liquid ejected onto the edge of the recording medium are smaller. Therefore, the amounts of the ink and reactive liquid which land on the platen are smaller. Therefore, the platen is less contaminated. Making a structural arrangement so that reactive liquid is not ejected either onto the edge region of a recording medium or outward of the recording medium prevents the deterioration in absorbency of the absorbent member placed in the recording medium conveyance path, making it less likely for chemical compounds to be formed by a substantial amount from the ink and reactive liquid. Therefore, it is less likely for the chemical compounds to interfere with the recording medium conveyance.

(vii) Recording Method Using No Reactive Liquid

As described above, when ink and reactive liquid are ejected onto the edge region of a recording medium and slightly outward of the edge while recording with the provision of no margin, the ink and reactive liquid react with each other in the absorbing member placed in the recording medium conveyance path, deteriorating the absorbent member in absorbency. As the absorbency of the absorbent member deteriorates, the absorbent member sometimes overflows with ink. Thus, an arrangement is made so that in the borderless recording mode, only ink is used for recording; reactive liquid is not used. In the case of this arrangement, reactive liquid is not applied at all, and therefore, no chemical compounds traceable to the interaction between ink and reactive liquid are formed, and therefore, ink does not react with reactive liquid in the absorbent member placed in the recording medium conveyance path. In other words, the arrangement prevents the deterioration in absorbency of the ink absorbent member, which occurs when both ink and reactive liquid are used in the borderless recording mode.

(Difference between Borderless Recording Mode and Normal Recording Mode)

Into the borderless recording mode, recording conditions such as conditions (i)–(vi) (the condition regarding at least one of the amounts by which ink and reactive liquid are applied; the condition regarding the number of times a given portion of a recording medium is scanned by the ink ejecting portion or reactive liquid ejection portion; the condition regarding the regions of a recording medium to which ink and/or reactive liquid are applied; and the like conditions) can be incorporated, individually or in combination. In comparison, into the normal recording mode, that is, a recording mode in which recording is made with the provision of margins, recording conditions different from those incorporated into the borderless recording mode can be incorporated. Next, the difference between the borderless recording mode and normal recording mode will be described.

(1) First example: in the borderless recording mode, the split (multiscan) recording method (i), that is, a recording method, in which a given portion of an image is completed by scanning the recording area of a recording medium corresponding to the given portion of the image two or more times, is employed, whereas in the normal recording mode, the single-scan recording method, in which a given portion of an image is completed by scanning the recording area of a recording medium corresponding to this portion of the image only once, is employed. In other words, in the borderless recording mode, that is, a recording mode in which mist generation is likely to become a problem, the split (multiscan) recording method, which is effective for mist reduction, is employed, whereas in the normal recording mode, that is, a recording mode in which mist generation does not become as great a problem as it does in the borderless recording mode, the single-pass recording method, that is, a recording method capable of completing an image in a shorter time, is employed. Therefore, an image is recorded under the optimal conditions whether in the borderless recording mode or normal recording mode.

(2) Second example: the number of times the region of a recording medium corresponding to a given portion of an image to be recorded is scanned in the borderless recording mode is made greater than that in the normal recording mode. For example, an arrangement is made so that in the normal recording mode, the region is scanned twice, whereas in the borderless recording mode the region is scanned only once. Instead, an arrangement may be made so that when an image is formed in the normal recording mode, the region is scanned only once, whereas in the borderless recording mode, the region is scanned four times. In other words, in the borderless recording mode, that is, a recording mode in which mist reduction is strongly required, the scan count for a given area of a recording medium is increased for mist reduction, whereas in the normal recording mode, the scan count is reduced for recording time reduction.

(3) Third example: in the borderless recording mode, the split (multiscan) recording method and single-pass recording method are used in combination as in the recording method (ii), whereas in the normal recording mode, the single-pass recording method is used. This arrangement also can reduce the amounts by which ink mist and reactive liquid mist are formed in the borderless recording mode, reducing the contamination as in Examples (1) and (2).

(4) Fourth example: an arrangement is made so that in the borderless recording mode, the ejection data are thinned as in the recording method (iii), whereas in the normal recording mode, the ejection data are not thinned, or that the ratio at which the ejection data are thinned in the borderless recording mode is made greater than that in the normal recording mode. In other words, in the borderless recording mode, that is, a recording mode in which mist reduction is strongly required, the ejection data thinning ratio is increased for mist reduction, whereas in the normal recording mode, the ejection data thinning ratio is reduced for the realization of high density recording. Incidentally, thinning the ejection data for ink and/or reactive liquid suffices for mist reduction. However, thinning the ink ejection data results in recording density reduction. Therefore, it is desired that only the reactive liquid ejection data are thinned. Thus, an arrangement is made so that in the borderless recording mode, only the reactive liquid ejection data are thinned. On the other hand, it is desired that an arrangement is set up so that in the normal recording mode, neither the ink ejection data nor the reactive liquid ejection data are thinned. Further, when the reactive liquid ejection data are thinned in both the borderless recording mode and normal recording mode, it is desired that the reactive liquid ejection data thinning ratio for the borderless recording mode is set higher than that for the normal recording mode.

(5) Fifth example: an arrangement is made so that in the borderless recording mode, the volume of a droplet in the form of which ejection is made is reduced for ink and/or reactive liquid. In other words, in the borderless recording mode, that is, a recording mode in which mist reduction is strongly required, the volume of a droplet in the form of which ink and reactive liquid are ejected from an ejection orifice is reduced, whereas in the normal recording mode, the volume of a droplet in the form of which ink and reactive liquid are ejected from an ejection orifice is increased for the realization of high density recording.

(6) Sixth example: in the borderless recording mode, at least one of the amounts by which ink and reactive liquid are applied to the edge region of a recording medium is reduced as in the recording method (v), whereas in the normal recording mode, the amounts by which ink and reactive liquid are applied to the edge region of a recording medium are kept the same as those for the region of the recording medium other than the edge region. According to this structural arrangement, in the borderless recording mode which is high in the probability that ink and reactive liquid will adhere to the platen, the amounts by which ink and reactive liquid are applied to the edge region are reduced, reducing therefore the amount by which ink and reactive liquid adhere to the platen; the platen is less contaminated.

In the case of this sixth example, it is desired that control is executed so that in the borderless recording mode, reactive liquid is not ejected onto the edge region, whereas in the normal recording mode, reactive liquid is ejected onto the edge region. In this case, in the borderless recording mode, the region to which ink is applied is different from the region to which reactive liquid is applied, whereas in the normal recording mode, the region to which ink is applied is the same as the region to which reactive liquid is applied, in terms of the primary scanning direction.

(7) Seventh example: an arrangement is made so that in the borderless recording mode, recording is made using only ink (reactive liquid is not used) as in the recording method (vi), whereas in the normal recording mode, recording is made using both ink and reactive liquid. In this case, in the borderless recording mode, reactive liquid is not used at all. Therefore, it does not occur at all that the chemical compounds are produced from ink and reactive liquid, or that ink and reactive liquid react with each other in the absorbent member placed in the recording medium conveyance path. Therefore, the aforementioned various problems (contamination of recording apparatus interior (for example, platen), contamination of the reverse side of a recording medium, and deterioration in absorbency of the ink-absorbing member), which occur when recording is made in the borderless recording mode, using both ink and reactive liquid, are prevented.

As described above, optimal recording can be realized in both the first mode (borderless mode) in which recording is made with provision of no margin along a minimum of one of the edges of a recording medium, and the second mode (normal recording mode) in which recording is made with the provision of margin along all four edges of a recording medium, by varying the recording conditions (condition regarding at least one of the amounts by which ink and reactive liquid are applied; condition regarding the number of times a given portion of a recording medium is scanned by the ink ejecting portion or reactive liquid ejecting portion; condition regarding the regions of a recording medium to which ink and/or reactive liquid are applied; and the like) depending on the recording mode. In each of the first to seventh examples (1)–(7), the difference made in recording conditions between the borderless recording mode and normal recording mode was described with reference to only one example. However, the difference made in recording conditions between the borderless recording mode and normal recording mode does not need to be limited to those described above.

(Means for Detecting (Determining) Whether Recording to be Made without Margin (Borderless Mode) or with Margin (Normal Mode))

Figure 8:
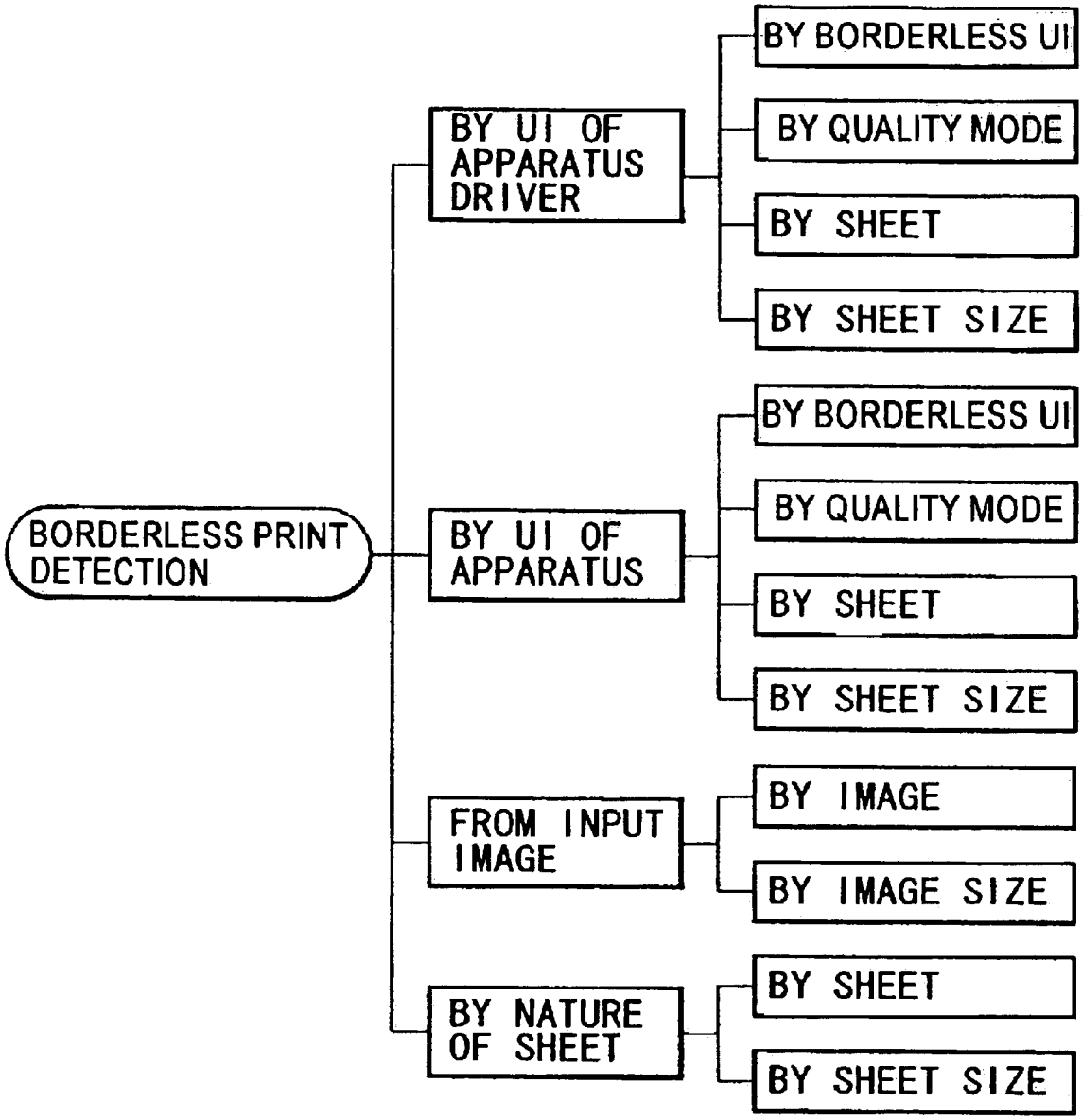
FIG. 8 is a chart for depicting the method for detecting the information indicating that an image is to be recorded in the borderless mode.

FIG. 8 shows a means for detecting that recording is to be made in the borderless mode. The recording mode can be detected through the UI of the driver of the recording apparatus or the UI of the recording apparatus main assembly, and also based on the characteristics of an intended image, characteristics of a recording medium, and communication with an external apparatus. Next, these detecting means will be described.

(1. Detection through UI of Printer Driver of Recording Apparatus)

Figure 9:
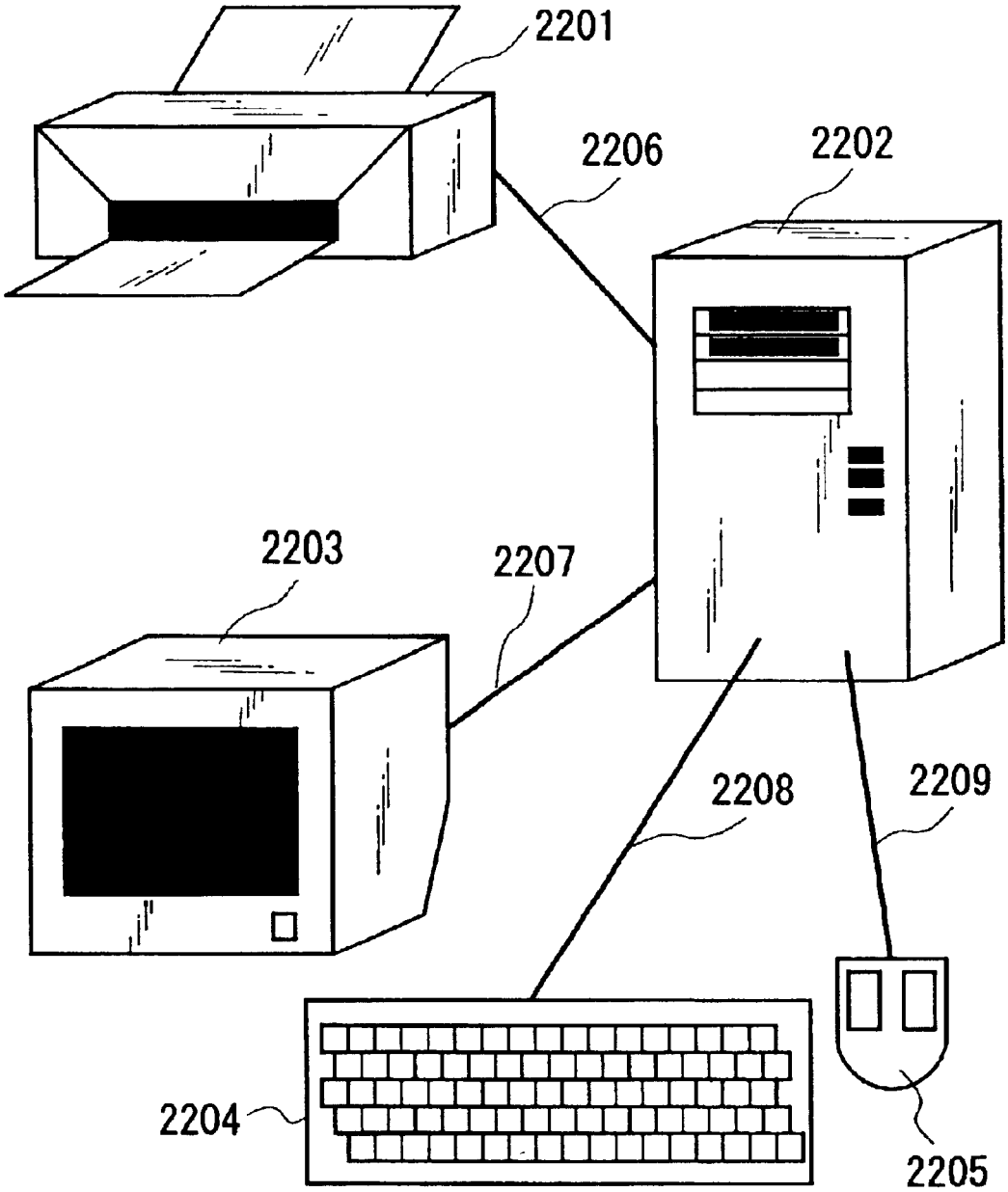
FIG. 9 is a drawing for showing an inkjet recording apparatus in accordance with the present invention, connected to a PC.

FIG. 9 shows an inkjet recording apparatus 2201 electrically connected, with the use of cables 2206–2209, to various external apparatuses: a personal computer 2202 (PC), a monitor 2203, a key board 2204, and a mouse 2205. In FIG. 9, the UI of the printer driver of the inkjet recording apparatus 2201, which is in the memory of the PC 2202, is displayed on the monitor 2203. A user is allowed to operate the UI using the keyboard 2204 and mouse 2205 to make various selections (set various modes). The UI includes a button for selecting the borderless recording mode; whether a user wants the borderless recording mode or not is detected (determined) based on whether the button is pressed or not. In the above, the marking for setting the borderless recording mode was called a button. However, the marking may be an icon, or a check-box.

Further, the driver has a table, such as Table 1, which contains the information regarding the available combination between the borderless recording mode, and image type selection, recording medium type selection, and recording medium size selection (in Table 1, compatibility with borderless recording mode is represented by "G", and incompatibility with borderless recording mode is represented by "NG"). The item selected by a user using the UI is referenced to the table. When the item represented by "G" is selected, the information that the borderless recording mode has been selected is detected, and the borderless recording mode is set. For example, if a user selects "PHOTO" on the UI, it is determined from the table, in which the "PHOTO" row has "G" in borderless recording mode column, that the borderless recording mode is to be set, and the borderless recording mode is set. If a user chooses "DOCUMENT" on the UI, it is determined from the table, in which the "DOCUMENT" row has "NG" in the borderless recording mode column, that the borderless recording mode is not be set, and the normal recording mode (recording mode with provision of margin) is set.

TABLE 1

| | SELECTION | BORDERLESS |
|---|---|---|
| QUALITY MODES | PHOTO | G |
| | GRAPHIC | G |
| | DOCUMENT | NG |
| SHEETS | GLOSSY | G |
| | COATED | NG |
| | PLAIN | NG |
| SIZES | A3 | NG |
| | A4 | G |
| | POSTCARD | G |

G: GOOD
NG: NO GOOD

The information in the table stored in the driver may be such as the information in Table 2. In the case of Table 2, each row in the image quality column, recording medium type column, and recording medium size column is given a value ("0" or "1"). When the logical multiplication of the item selected through the UI is "1", the information that recording is to be made in the borderless recording mode is detected, and the borderless recording mode is set. For example, if a user selects "PHOTO" (having the value of "1") as image quality, "GLOSSY" (having the value of "1") as recording medium, and "POSTCARD" (having the value of "1") as recording medium size, the logical multiplication (1 and 1 and 1) is one; it is detected that the user selected the borderless recording mode. Thus, the borderless recording mode is set. On the other hand, if a user selects "PHOTO" (having the value of "1") as image quality, "PLAIN" (having the value of "0") as recording medium type, and "POSTCARD" (having the value of "1") as recording medium size, the logical multiplication (1 and 0 and 1) is zero; it is detected that the user did not select the borderless recording mode. Thus, the recording mode with the provision of margin (normal recording mode) is set.

TABLE 2

| QUALITY MODES | VALUE | SHEETS | VALUE | SIZES | VALUE |
|---|---|---|---|---|---|
| PHOTO | 1 | GLOSSY | 1 | A3 | 0 |
| GRAPHIC | 1 | COATED | 0 | A4 | 1 |
| DOCUMENT | 0 | PLAIN | 0 | POSTCARD | 1 |

Figure 10:
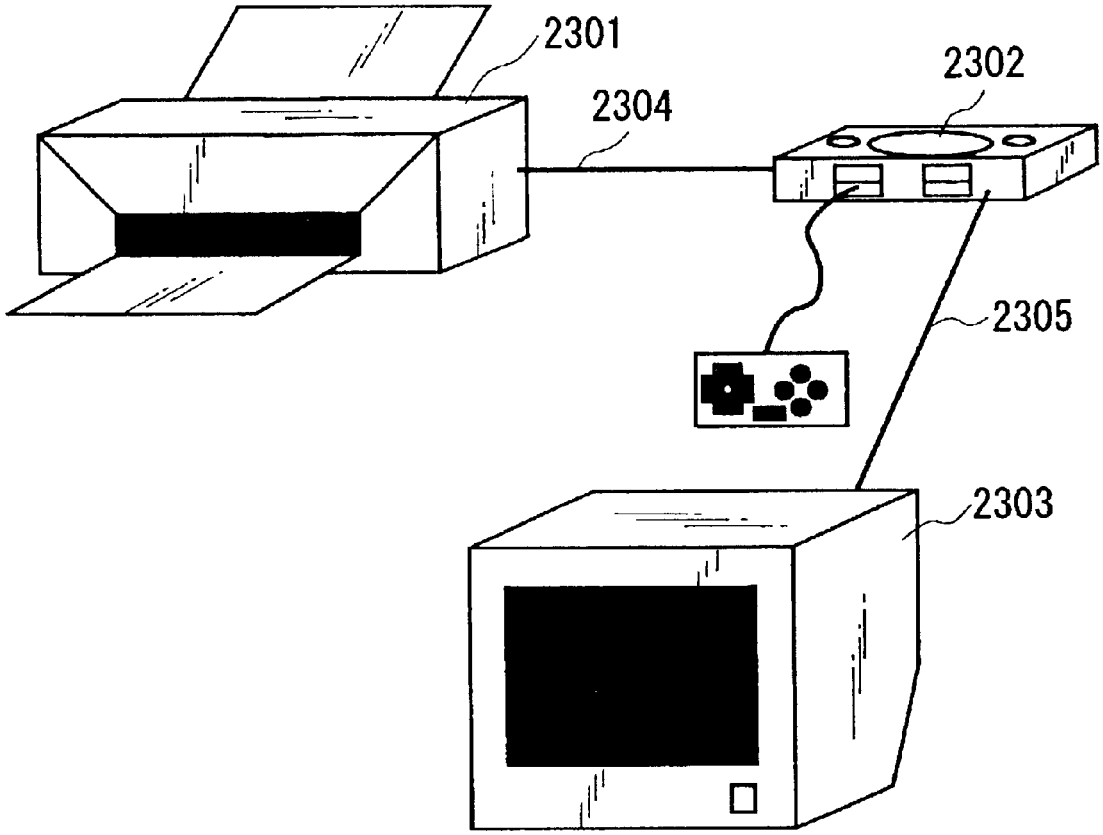
FIG. 10 is a drawing for showing an inkjet recording apparatus connected to a game machine.

In the above, the description was given with reference to an equipment configuration in which an inkjet recording apparatus was connected to a PC as shown in FIG. 9. In addition to the above configuration, if the driver of a game machine 2302 is connected to the inkjet recording apparatus 2301 as shown in FIG. 10, the information that a user selected the borderless recording mode can be detected through the driver UI as described above. Further, when a portable terminal having a driver is connected to an inkjet recording apparatus, the selection of the borderless recording mode can be detected through the driver UI in the same manner as described above, although not illustrated.

Incidentally, "connection" in the above may be wireless connection with the use of a "Bluetooth"® device, although wireless connection is not limited to "Bluetooth"® connections.

Also in the above description, whether the borderless recording mode is to be set or not was detected based on the selections in image quality, recording medium type, and recording medium size. However, it may be detected based on other factors, for example, recording method, recording conditions, and the like. Further, in each of the image quality, recording medium type, and recording size columns, three items were provided for selection. However, the number of the selectable items does not need to be limited to three.

(2. Detection through UI of Recording Apparatus Main Assembly)

Figure 11:
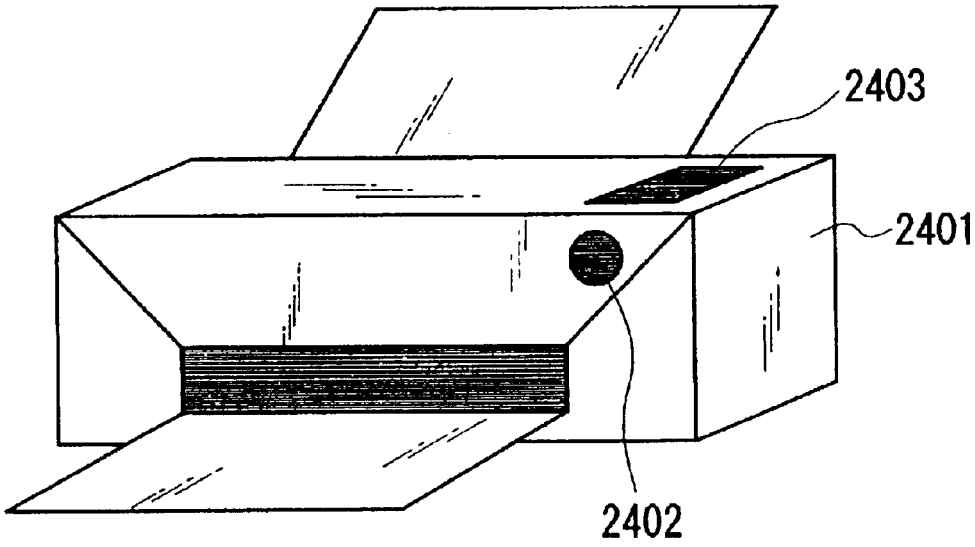
FIG. 11 is a schematic perspective view of an inkjet recording apparatus equipped with a control panel.

Referring to FIG. 11, the inkjet recording apparatus 2401 is equipped with a button 2402 for setting the borderless recording mode, and whether or not recording is to be made in the borderless recording mode is detected based on whether or not a user selected this borderless recording mode button.

The inkjet recording apparatus is also equipped with a control panel 2403, which can be operated by a user to choose one of various settings. The control panel 2403 is provided with a button for setting the borderless recording mode, and whether or not recording is to be made in the borderless recording mode is detected based on whether or not a user selected this borderless recording mode button. Incidentally, in the above, the means for setting the borderless recording mode was described as a button. However, it may be an icon or a check-box.

The control panel 2403 is enabled to be used for selecting image quality, recording medium type, and recording medium size. The selection made by a user through the control panel 2403 is looked up in a stored table such as Table 1. If the selection has "G" in the table, the information that recording is to be made in the borderless recording mode is detected, and the borderless recording mode is set. For example, if a user selects "GLOSSY" as recording medium type selection with the use of the control panel 2403, it is determined that recording is to be made in the borderless recording mode, because the selection in Table 1 has "G". Thus, the borderless recording mode is set.

The information in the table stored in the driver may be such as the information in Table 2. In the case of Table 2, each row in the image quality column, recording medium type column, and recording medium size column is given a value ("0" or "1"). When the logical multiplication of the item selected through the control panel 2403 is "1", the information that recording is to be made in the borderless recording mode is detected, and the borderless recording mode is set. For example, if a user selects "GRAPHIC" (having the value of "1") as image quality, "GLOSSY" (having the value of "1") as recording medium type, and "A4" (having the value of "1") as recording medium size, the logical multiplication (1 and 1 and 1 ) is one, and it is determined that the user selected the borderless recording mode. Thus, the borderless recording mode is set. On the other hand, if a user selects "GRAPHIC" (having the value of "1") as image quality, "GLOSSY paper" (having the value of "1") as recording medium, and "A3" (having the value of "0") as recording medium size, the logical multiplication (1 and 1 and 0) is zero, and it is determined that the recording is not made in the borderless recording mode, and the recording mode with the provision of margin (normal recording mode) is set.

Also in the above description, whether the borderless recording mode is to be set or not was detected based on the user selections in image quality, recording medium type, and recording medium size. However, it may be detected based on other factors, for example, recording method, recording conditions, and the like, which are selectable with the use of the control panel 2403. Further, in each of the image quality, recording medium type, and recording size columns, three items (choices) were provided for selection. However, the number of the selectable items (choices) does not need to be limited to three.

(3. Detection Based on Characteristics of Intended Image)

In this case, the information regarding whether recording is made with or without the provision of margins is prepared in advance in the form of a table such as Table 3, which comprises two sections: top and bottom sections. The top section shows the relationship between image type and recording mode, and the bottom section shows the relationship between the number of picture elements (picture element count) and recording mode. For example, if a user chooses "PHOTO" as the type of the intended image, the information that recording is to be made in the borderless recording mode is detected, because the "PHOTO" row in the recording mode column has "G". Thus, the borderless recording mode is set.

TABLE 3

| | SELECTION | BRIMLESS |
|---|---|---|
| INPUT IMAGES | PHOTO | G |
| | GRAPHIC | G |
| | DOCUMENT | NG |
| PIXEL | <1280 × 960 | NG |
| | ≧1280 × 960 | G |

G: GOOD
NG: NO GOOD

Instead of a table such as Table 3, a table such as Table 4 may be prepared in advance. In the case of Table 4, a value "0" or "1" is assigned to each item (choice) in the image type column and picture element count column. When the logical multiplication between the item selected by a user in the image type column and the item in the picture element column is "1", the information that recording is to be made in the borderless recording mode is detected, and the borderless recording mode is set. For example, if "PHOTO" and "no less than 1280×960" are selected in combination as image type and picture element count, respectively, the logical multiplication (1 and 1) is one. Therefore, the information that recording is to be made in the borderless recording mode is detected, and the borderless recording mode is set. On the other hand, if "DOCUMENT" and "no less than 1280×960" are selected in combination as the image type and picture element count, respectively, the logical multiplication (0 and 1) is zero. Therefore, the information that recording is not to be made in the borderless recording mode is detected, and the normal recording mode (recording mode with margins) is set.

TABLE 4

| INPUT IMAGE | VALUE | NO. OF PIXEL | VALUE |
|---|---|---|---|
| PHOTO | 1 | <1280 × 960 | 0 |
| GRAPHIC | 1 | ≧1280 × 960 | 1 |
| DOCUMENT | 0 | | |

In the above, whether the borderless recording mode is to be set or not was detected based on the user selections in image type and picture element count. However, it may be detected based on factors other than the resolution of the intended image; it may be detected based on the characteristics of the intended image obtainable from the file of the intended image, for example, magnification, object type, and the like photographic data. Further, in the image type and picture element count columns, three and two items (choices), respectively, were provided for selection. However, the number of the selectable items (choices) does not need to be limited to these.

(4. Detection Based on Characteristics of Recording Medium)

Figure 12:
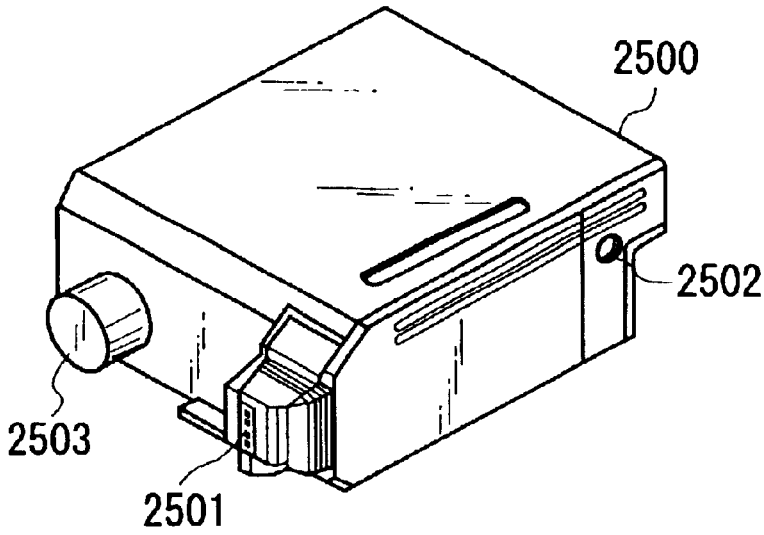
FIG. 12 is a perspective view of a cartridge equipped with an optical sensor for measuring the reflectance of a recording medium.

In this case, the information regarding whether recording is made with or without the provision of margins is prepared in advance in the form of a table such as Table 5, which comprises two sections: top and bottom sections. The top section shows the relationship between recording medium type and recording mode, and the bottom section shows the relationship between the recording medium size and recording mode. The information that recording is to be made in the borderless recording mode is detected based on this table and the selected recording medium type, and the borderless recording mode is set. More specifically, referring to FIG. 12, a printing cartridge 2500 is provided with an optical sensor 2503, which measures the optical reflectance of a recording medium. From the thus obtained optical reflectance of the recording medium, and the predetermined relationship between optical reflectance and recording medium type, the type of the recording medium currently in use can be determined. For example, when it is detected that the recording medium currently in use is glossy paper based on the above described measurement, the borderless recording mode is set, because the row that contains "GLOSSY" in the recording medium type column has "G" in the recording mode column. Thus, the borderless recording mode is set. Although FIG. 12 shows the optical sensor which is an integral part of the printing cartridge, the optical sensor and printing cartridge may be discrete. For example, the optical sensor may be directly attached to the carriage, instead of the printing cartridge.

TABLE 5

| | SELECTION | BORDERLESS |
|---|---|---|
| SHEETS | GLOSSY | G |
| | COATED | G |
| | PLAIN | NG |
| SIZES | A3 | NG |
| | A4 | G |
| | POSTCARD | G |

G: GOOD
NG: NO GOOD

Figure 13:
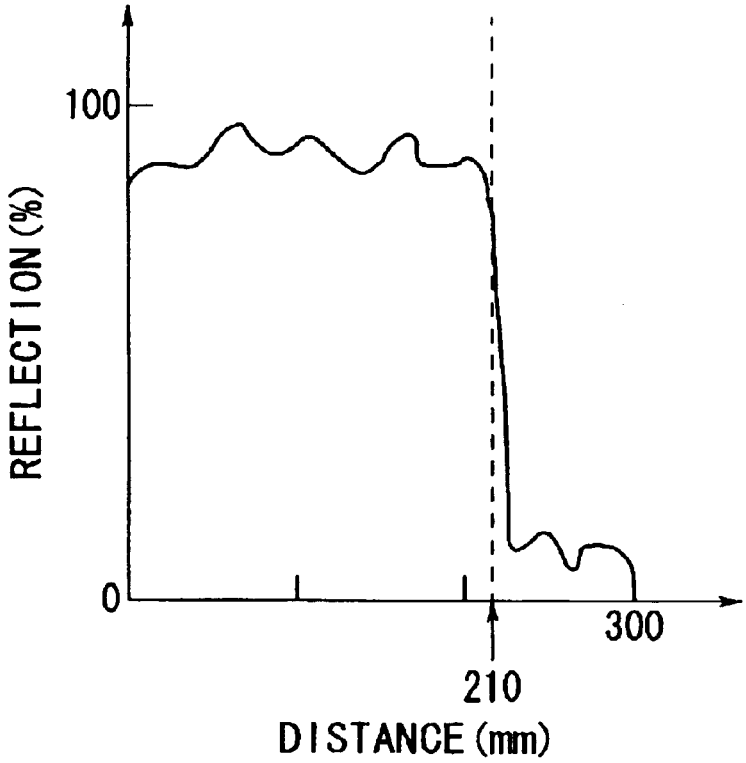
FIG. 13 is a graph for showing the reflectance of a recording medium.

Instead of a table such as Table 5, a table such as Table 6 may be prepared in advance. In the case of Table 6, a value "0" or "1" is assigned to each item (choice) in the image type column and recording medium size column. When the logical multiplication between the item selected by a user in the image type column and the item in the recording medium size column is "1", the information that recording is to be made in the borderless recording mode is detected, and the borderless recording mode is set. More specifically, as the optical sensor 2503 shown in FIG. 12 scans the surface of the recording medium currently in use, the optical reflectance of the recording medium is measured, which is shown in FIG. 13. Referring to FIG. 13, when the optical sensor 2503 is above the recording medium, the value of the detected optical reflectance remains close to 100%.

However, in the range where the scan distance of the optical sensor 2503 is no less than 210 mm in FIG. 13, in other words, when the optical sensor 2503 is outside the recording medium range, the value of the measured optical reflectance is close to 0%. Thus, it is determined that the recording medium width is 210 mm; in other words, the size of the recording medium currently in use is A4. Further, the optical reflectance of recording medium can be used to determine the recording medium type. For example, when it is detected based on the measured optical reflectance that the recording medium currently in use is "GLOSSY", the information that recording is to be made in the borderless recording mode is detected, because the logical multiplication (1 and 1) is one. Thus, the borderless recording mode is set.

TABLE 6

| SHEETS | VALUE | SIZES | VALUE |
|---|---|---|---|
| GLOSSY | 1 | A3 | 0 |
| COATED | 1 | A4 | 1 |
| PLAIN | 0 | POSTCARD | 1 |

In the above description, the decision regarding the whether or not recording is made in the borderless recording mode is made based on the type and size of a recording medium. However, it may be made based on the recording medium characteristics other than those mentioned above. Further, in both the image type and recording medium size columns, three items (choices) were provided for selection. However, the number of the selectable items (choices) does not need to be limited to these. Further, although optical reflectance was used as means for determining the type and size of a recording medium, in this embodiment, the method for determining the type and size of a recording medium does not need to be limited to the above described one.

(5. Detected Based on Communication with External Apparatus)

In this case, the recording apparatus main assembly is connected to an external apparatus, and the information regarding whether recording is to be made in the borderless recording mode or not is detected based on the communication between the recording apparatus main assembly and the external apparatus, for example, a digital camera, a scanner, or the like of a portable type. For example, when a digital camera is connected to the recording apparatus main assembly, the information regarding the setting of the digital camera is transmitted to the recording apparatus main assembly. Then, the information regarding whether recording is to be made in the borderless recording mode or not is detected based on the information regarding the recording mode, image resolution, and the like. Further, an arrangement may be made so that whenever image formation data are received from a digital camera, the borderless recording mode is set.

Hereinafter, reaction systems 1, 2 and 3 employed in the present invention will be described. In the following description of these systems, "part"and "%" means "part in weight" and "wt. %", unless specifically noted. Reaction system 1 is based on Prior Art (1). It is a combination of ink and liquid composition which are reactive to each other. In the embodiments of the present invention and comparative examples, which will be described next, the combination disclosed in Japanese Laid-open Patent Application No. 8-224955 was used. The reaction system 2 is based on Prior Art (2). It is a combination of ink ( black ink) and ink (color ink) which are reactive with each other. In the embodiments and comparative examples, which will be described next, a combination disclosed in Japanese Laid-open Patent Application No. 6-100811 was used. The reaction system 3 is based on technology discovered by the inventors of the present invention, and is different from the prior art. It is also a combination of ink and liquid composition. However, the ink and liquid composition in this system are opposite in polarity, and the liquid composition contains microscopic particles.

(Reaction System 1)

(Production of Ink Subset 1)

The following ingredients were mixed, and the mixture was filtered with the use of a Fluoropore filter having a pore size of 0.22 $\mu$m, while applying pressure, obtaining black ink Bk1, yellow ink Y1, magenta ink M1, and cyan ink C1. A combination of Bk1, Y1, M1 and C1 will be referred to as ink subset 1.

| | |
|---|---|
| <Bk1 composition> | |
| C.I. food black | 24.0 parts |
| Thiodiglycol | 10 parts |
| Acetynol EH (Kawaken Chemicals Co. Ltd.) | 0.05 part |
| Ion-exchange water | 85.95 parts |
| <Y1 composition> | |
| C.I. direct yellow 142 | 2 parts |
| Thiodiglycol | 10 parts |
| Acetynol EH (Kawaken Chemicals Co. Ltd.) | 0.05 part |
| Ion-exchange water | 87.95 parts |
| <M1 composition> | |
| C.I. acid 922 | 5 parts |
| Thiodiglycol | 10 parts |
| Acetynol EH (Kawaken Chemicals Co. Ltd.) | 0.05 part |
| Ion-exchange water | 87.45 parts |
| <C1 composition> | |
| C.I. direct blue 1992 | 5 parts |
| Thiodiglycol | 10 parts |
| Acetynol EH (Kawaken Chemicals Co. Ltd.) | 0.05 part |
| Ion-exchange water | 87.45 parts |

(Production of Liquid Composition 1)

The following ingredients were mixed, and the mixture was filtered with the use of a Fluoropore filter having a pore size of 0.22 $\mu$m, while applying pressure, obtaining Liquid Composition 1.

| <Liquid Composition 1> | |
|---|---|
| Polyarylamine (Internally synthesized) | 5 parts |
| Polyallylamine hydrochloride (Internally synthesized) | 3 parts |
| Thiodiglycol | 10 parts |
| Ion-exchange water | 82 parts |

(Reaction System 2)

(Production of Ink Subset 2)

The following ingredients were mixed, and the mixture was filtered with the use of a Teflon filter having a pore size of 1 $\mu$m, while applying pressure, obtaining black ink Bk2, yellow ink Y2, magenta ink M2, and cyan ink C2. A combination of Bk2, Y2, M2 and C2 will be referred to as ink subset 2. The coloring agent of Bk2 displays cathionic properties, and the coloring agents of Y2, M2 and C2 display anionic properties.

| | |
|---|---|
| <Bk2 composition> | |
| Diacryl Supra Black ESL (product of Mitsubishi) | 3 parts |
| Ethylene glycol | 10 parts |
| Sulfolane | 5 parts |
| Cyclohexanol | 2 parts |
| Acetynol EH (Kawaken Chemicals Co. Ltd.) | 0.05 part |
| Ion-exchange water | 80 parts |
| <Y2 composition> | |
| C.I. direct yellow 293 | 3 parts |
| Ethylene glycol | 10 parts |
| Sulfolane | 5 parts |
| Cyclohexanol | 2 parts |
| Acetynol EH (Kawaken Chemicals Co. Ltd.) | 1 part |
| Ion-exchange water | 79 parts |
| <M2 composition> | |
| C.I. acid red 289 | 3 parts |
| Ethylene glycol | 10 parts |
| Sulfolane | 5 parts |
| Cyclohexanol | 2 parts |
| Acetynol EH (Kawaken Chemicals Co. Ltd.) | 1 part |
| Ion-exchange water | 79 parts |
| <C2 composition> | |
| C.I. direct blue 199 | 3 parts |
| Ethylene glycol | 10 parts |
| Sulfolane | 5 parts |
| Cyclohexanol | 2 parts |
| Acetynol EH (Kawaken Chemicals Co. Ltd.) | 1 part |
| Ion-exchange water | 79 parts |

(Reaction System 3)

The reaction system 3 is based on technology not found among the prior art, and was discovered by the inventors of the present invention. Next, a recording method which uses the reaction system 3 will be described.

It is generally known that in order to obtain an image with a high level of color saturation, it is desired that the coloring agents remain unagglomerated, that is, discrete. The reaction system 3 is a realization of this desire. In other words, the reaction system 3 is a result of the further development of the art for keeping as large an amount of the coloring agents on the surface of a recording medium as possible, in the discrete form. Hereafter, a recording method which uses the reaction system 3 will be described in detail with reference to FIG. 4.

Before starting to describe the system, the definitions of the technical terms in the present invention will be described. In this embodiment, "discrete"means that coloring agents such as dye, pigment, or the like mostly remain dissolved, or dispersed, in ink. It should be noted here that even if a certain amount of coloring agents in an ink have agglomerated, as long as such agglomeration did not result in the deterioration of color saturation, the coloring agents in this ink are considered to be "discrete". For example, dye is desired to be discrete. Therefore, the expression "discrete" will be also used with the coloring agents other than dye.

Figure 4:
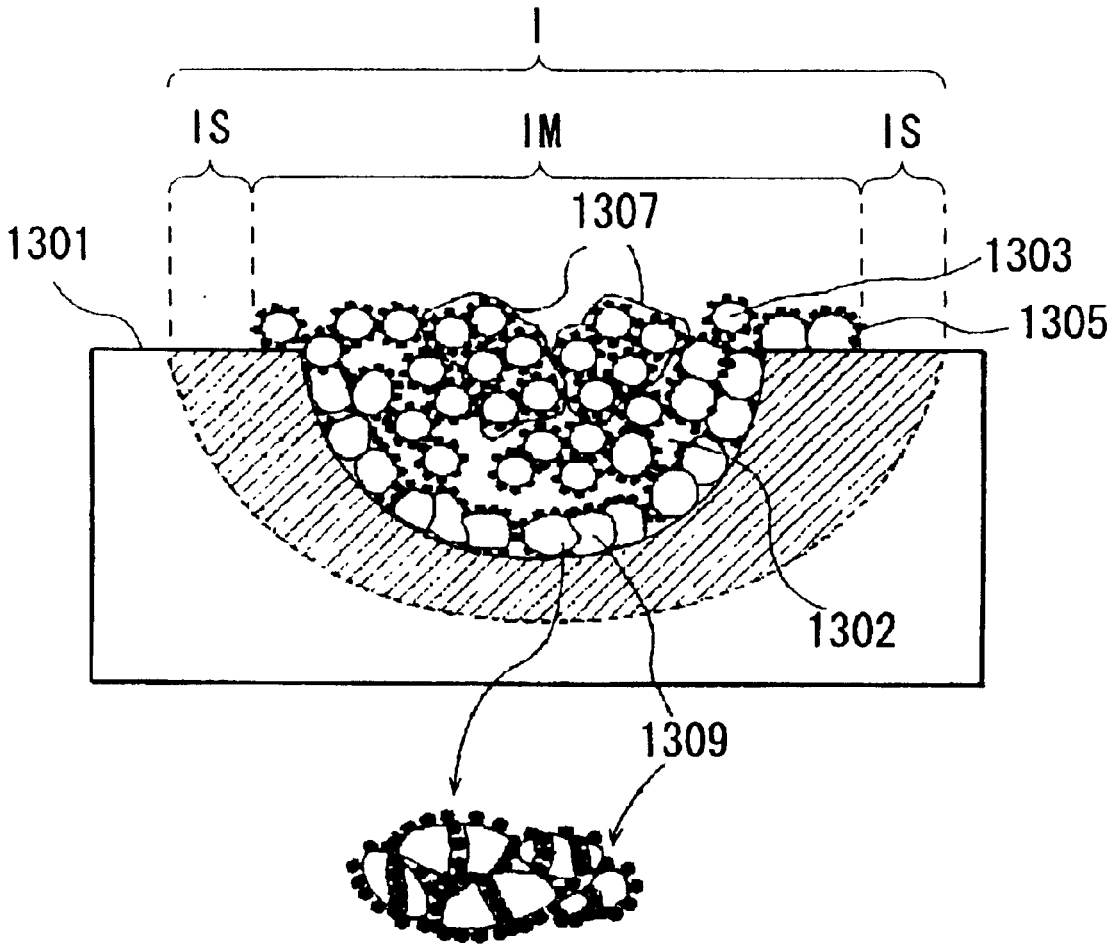
FIG. 4 is a drawing for depicting the colored portion of a print produced by an inkjet recording apparatus in accordance with the present invention.

FIG. 4 is a schematic sectional view of a colored portion 1 of a recording medium, for showing that the colored portion 1 comprises a main portion IM and a peripheral portion IS. In FIG. 4, reference numeral 1301 represents a recording medium, and reference numeral 1302 represents the gaps among the fibers of the recording medium. Reference numeral 1303 represents a schematically drawn microscopic particle to which a coloring agent 1305 has chemically adhered. Referring to FIG. 4, in an image recorded by an inkjet recording apparatus in accordance with the present invention, the main image portion IM comprises microscopic particles 1303 to which coloring agents have evenly and discretely or virtually discretely (which hereinafter will be simply represented by "discretely") adhered, and agglomerates 1307 of the microscopic particles to which the coloring agents have discretely adhered. Reference numeral 1309 represents an agglomerate of the microscopic particles, which are present adjacent to the recording medium fibers within the primary portion IM. The primary portion IM is formed through the process in which the microscopic particles 1303 physically or chemically adhere to the recording medium fibers, and the process in which the coloring agents 1305 and microscopic particles 1305 adhere to each other in the "liquid-to-liquid state". Therefore, the amount by which the color development properties of the coloring agent itself are impaired is small. Thus, the reaction system 3 displays high levels of image density and color saturation, even when it is ejected onto recording medium such as standard paper, into which ink easily sinks. In other words, it is capable of forming, even on standard paper, an image which is virtually equivalent in color reproduction to an image formed on coated paper.

On the other hand, the coloring agents 1305, which remain in the ink without being adhered to the surfaces of the microscopic particles 1303, permeate the recording medium 1301 horizontally as well as vertically, creating tiny ink blotches in the peripheral portion IS, adjacent to the primary portion. In other words, the reaction system 3 leaves the coloring agents close to the surface of the recording medium 1301, and also creates tiny ink blotches next to the primary portion. Therefore, an image formed using the reaction system 3 is smaller in the amount of hazy white defects and unevenness in color, even in the shadow areas or solid areas, which are greater in the amount of ink application. In other words, the reaction system 3 is capable of producing an image superior in color uniformity. Incidentally, in this embodiment, when a recording medium such as the recording medium 1301 shown in FIG. 4, which is permeable by ink and liquid composition containing microscopic particles, the ingredients of the ink and the ingredients of the liquid composition containing the microscopic particles are not necessarily prevented from permeating the recording medium; they are allowed to permeate the recording medium to some degree.

Further, when the liquid composition in accordance with the present invention, which contains microscopic particles, is used, small pores with a certain size are formed within the agglomerates while the agglomerates 1309 of the microscopic particles are formed close to the recording medium surface. The aforementioned discrete coloring agents 1305 in the ink enter the small pores of the agglomerates 1309 of the microscopic particles, adhering to the adjacencies of the entrances of the small pores and the internal walls of the small pores, as they permeate deeper into the recording medium. As a result, a greater amount of coloring agents remain close to the recording medium surface, making it possible to form a print or a copy far superior in color development.

Hereinafter, the production of the ink subset 3 of the reaction system 3, and microscopic particle containing liquid composition 3, in the present invention, will be described.

(Production of Ink Subset 3)

The following ingredients were mixed, and the mixture was filtered with the use of a Fluoropore filter having a pore size of 0.45 μm, while applying pressure, obtaining black ink Bk3, yellow ink Y3, magenta ink M3 and cyan ink C3. A combination of Bk3, Y3, M3 and C3 will be referred to as ink subset 3. The coloring agent of Bk3 displays cationic properties, and the coloring agents of Y3, M3 and C3 display anionic properties in ink.

| | |
|---|---|
| <Bk3 composition> | |
| C.I. direct black 195 | 2.5 parts |
| 2-pyrrolidone | 10 parts |
| Glycerine | 5 parts |
| Isopropyl alcohol | 4 parts |
| Sodium hydroxide | 0.4 part |
| Ion-exchange water | 78.1 parts |
| <Y3 composition> | |
| Project Fast Yellow 2 (product of Zeneca Co. Ltd.) | 2 parts |
| C.I. direct yellow 86 | 1 part |
| Thiodiglycol | 8 parts |
| Ethylene glycol | 8 parts |
| Acetynol EH (Kawaken Chemicals Co. Ltd.) | 0.2 part |
| Isopropyl alcohol | 4 parts |
| Ion-exchange water | 76.8 parts |
| <M3 composition> | |
| Project Fast Magenta 2 (product of Zeneca Co. Ltd.) | 3 parts |
| Glycerine | 7 parts |
| Urea | 7 parts |
| Acetynol EH (Kawaken Chemicals Co. Ltd.) | 0.2 part |
| Isopropyl alcohol | 4 parts |
| Ion-exchange water | 78.8 parts |
| <C3 composition> | |
| C.I. direct blue 199 | 3 parts |
| Ethylene glycol | 7 parts |
| Diethylene glycol | 10 parts |
| Acetynol EH (Kawaken Chemicals Co. Ltd.) | 0.3 part |
| Ion-exchange water | 79.7 parts |

(Production of Microscopic Particle Containing Liquid Composition 3)

The following ingredients were mixed and dissolved, and the mixture was filtered with the use of a membrane filter (product of Sumitomo Electric Industries Ltd.; brand name: Fluoropore filter) having a pore size of 1 μm, while applying pressure, obtaining the microscopic particle (which hereinafter will be referred to as micro-particle) containing liquid composition in accordance with the present invention.

(Synthesis of Alumina Hydrate)

First, aluminum dodecxide was produced using the method disclosed in the U.S. Pat. No. 4,242,271. Then, aluminum slurry was produced by hydrolyzing the aluminum dodecxide using the method disclosed in U.S. Pat. No. 4,202,870. Then, water was added to this slurry until the solid contents of the alumina hydrate became 8.2%. The pH of the alumna slurry was 9.7. Then, the pH of the alumina slurry was adjusted to 5.3 by the addition of nitric acid solution. Then, the slurry was aged eight hours in an autoclave at 120° C., obtaining choroidal sol. Then, the pH of this chroidal sol was adjusted to 4.0 using nitric acid, and condensed so that its solid contents density became 20%, obtaining alumina hydrate slurry. An alumina hydrate particle in this slurry became positively charged, displaying cationic properties. The alumina hydrate slurry was diluted with ion-exchanged water; the alumina hydrate particles were thinly dispersed in the ion-exchanged water. Then, this solution was dripped onto a collodion film, obtaining a small amount of sample to be measured. When this sample was observed through a transmission electron microscope, all microscopic particles were in the form of a flat plate.

(Composition of Micro-Particle Containing Liquid Composition 3)

| | |
|---|---|
| 1,5-pentanediole | 10.0 wt. parts |
| Ethylene glycol | 7.5 wt. parts |
| Alumina hydrate slurry | 50.0 wt. parts |
| Water | 32.5 wt. parts |

The above ingredients were mixed for 30 minutes using an emulsifying/dispersing machine TK Robo-mix (Tokushu-Kika Industries Co. Ltd.), at 3,000 rpm. Then, in order to remove larger particles, the mixture was subjected to a centrifuge (4,000 rpm: 15 minutes), obtaining the micro-particle containing liquid composition 3.

The thus obtained micro-particle containing liquid composition 3 was 3.9 in pH, 80 nm in average particle diameter, and +41 mV in zeta potential level. Then, the liquid composition 3 was filled in an ink container and was left therein for a month, at 60° C./dry, in order to test it for shelf life. Even after one month, no sediment was found in the ink container. Further, the liquid composition could be reliably ejected from a recording head. The pores in the micro-particle agglomerates obtained from the micro-particle containing liquid composition 3 that were 3 nm–30 nm in radius, were 0.90 ml/g in volume, and those that were no less than 30 nm in radius were 0.001 ml/g in volume. Further, those that were 3 nm–20 nm in radius were 0.89 ml/g in volume, and those that were no smaller than 20 nm in radius were 0.01 ml/g in volume.

The physical properties of the above-described micro-particle containing liquid composition 3 were evaluated using the following methods.

1) Average particle diameter of micro-particle

First, the micro-particle containing liquid composition 3 was diluted with ion-exchanged water so that the solid contents of the diluted liquid composition 3 became 0.1%. Then, the diluted liquid composition 3 was subjected to an ultrasonic cleaner for dispersion for five minutes. Then, the scattering power intensity was measured using an electrophoretic light scattering photometer ELS-8000 (Otsuka Denshi Co. Ltd.) along with a quartz cell, at a liquid temperature of 25° C. The average particle diameter was obtained from the measured scattering power intensity, using the software which came with the photometer, and cumulants analysis.

2) pH

Its pH was measured using a pH meter (Casterney pH meter D-14 (Horiba Seisakusho Co. Ltd.)) while keeping the liquid temperature at 25° C.

3) Zeta potential

The micro-particle containing liquid composition 3 was diluted with ion-exchanged water so that the solid contents of the diluted liquid composition 3 became 0.1%. Then, the zeta potential level was measured using a zeta potential meter BI-ZETA Plus (Brook Heaven Co. Ltd.) along with an acrylic cell, while keeping the liquid temperature at 20° C.

4) Pore radius and pore volume

After the completion of the pretreatment, which will be described next, the sample was placed in a cell, and was deaerated for eight hours at 120° C. Then, the pore radius and pore volume were measured using Omnisoap 1 (Cantachrome Co. Ltd.) and nitrogen absorption desorption method. The pore radius and pore volume were calculated using the method used by Barrett and his associates (J. Am. Chem. Society, Vol. 73, pp. 373–380, 1951).

(1) The micro-particle containing liquid composition 3 was heated 10 hours at 120° C. in the normal atmosphere, evaporating virtually the entirety of the solvent and drying the residue.

(2) The temperature of the dried residue was raised from 120° C. to 700° C. over one hour, and then, the residue was sintered three hours at 700° C.

(3) After the sintering, the temperature of the sintered residue was gradually reduced to the normal temperature, and the cooled residue was ground down into powder with the use of an agate mortar.

(Results of Evaluation of Image Recorded Using Reaction System 3)

Images were recorded using the combination of the inkjet recording apparatus shown in FIG. 1 and the reaction system 3, and the combination of the inkjet recording apparatus shown in FIG. 1 and only the ink subset 3. The recording medium was PPC paper (Canon Inc.).

Images of RGB color chart of High Resolution XYZ.CIE-LAB.RGB Standard Image (SHIPP) (Oversight: High Resolution Standard Image Production Committee, Publisher: Society of Imaging Electronic) were recorded using the reaction system 3, and the recorded color chart images were measured in color. Also, images of the above-described color chart were recorded using only the ink subset 3, and the recorded color chart images were measured in color. Then, the reaction system 3 and ink subset 3 were evaluated in terms of color development, based on the results of measurements. As for the color development evaluation, the three-dimensional range (which hereinafter will be referred to as color gamut volume) of color distribution was calculated using the method disclosed in the technical manuals of the above-described color chart, and then, the results of the calculations were compared. The color chart images were developed under the same conditions, and the colors of the color chart images were measured after the elapse of 24 hours since the recording. The light source was a Grating Spectrorino D50, and the field of view was 2 deg. The results were as follows. The reaction system 3 of the present invention was far superior than the ink subset 3; the color gamut volume of the images recorded using the reaction system 3 was no less than 1.7 times that of the images recorded using only the ink subset 3. Further, the images recorded using the reaction system 3 were also superior in uniformity and bleeding to those recorded using only the ink subset 3. Further, in terms of stripy unevenness, abrasion or scratch, and compatibility with recording media, the images recorded using the reaction system 3 were never inferior to those recorded using only the ink subset 3.

Embodiments 1–15

Embodiments 1–15 represent the following cases, in which borderless images were recorded on PPC papers (Canon Inc.) using the inkjet recording apparatus shown in FIG. 1, and one of the various combinations, shown in Table 7, among the above-described reaction systems 1–3, and three recording methods: split (multiscan) recording method, thinned ejection data recording method, and normal recording method. In these embodiments, the above-described liquid composition 1, Bk2, and micro-particle containing liquid composition 3, which react with the above-described ink subsets 1–3, are together called "reactive liquid".

TABLE 7

| EMBs. | INK SUBSET | PRINT METHOD | LIQUID | PRINT METHOD |
|---|---|---|---|---|
| 1 | 1 | ONE PATH | NO. 1 | DIV |
| 2 | 1 | DIV | NO. 1 | ONE PATH |
| 3 | 1 | DIV | NO. 1 | DIV |
| 4 | 1 | ONE PATH | NO. 1 | SKIP |
| 5 | 1 | DIV | NO. 1 | SKIP |
| 6 | 2 | ONE PATH | Bk2 | DIV |
| 7 | 2 | DIV | Bk2 | ONE PATH |
| 8 | 2 | DIV | Bk2 | DIV |
| 9 | 2 | ONE PATH | Bk2 | SKIP |
| 10 | 2 | DIV | Bk2 | SKIP |
| 11 | 3 | ONE PATH | NO. 3 | DIV |
| 12 | 3 | DIV | NO. 3 | ONE PATH |
| 13 | 3 | DIV | NO. 3 | DIV |
| 14 | 3 | ONE PATH | NO. 3 | SKIP |
| 15 | 3 | DIV | NO. 3 | SKIP |

Comparative Examples 1–3

Comparative Examples 1–3 represent the following cases, in which borderless images were recorded on PPC papers (Canon Inc.) using the inkjet recording apparatus shown in FIG. 1, and one of the combinations, shown in Table 8, among the above-described reaction systems 1–3, and the normal recording method.

TABLE 8

| COMP. | INK SUBSET | PRINT METHOD | LIQUID | PRINT METHOD |
|---|---|---|---|---|
| 1 | 1 | ONE PATH | NO. 1 | DIV |
| 2 | 2 | ONE PATH | Bk2 | ONE PATH |
| 3 | 3 | ONE PATH | NO. 3 | ONE PATH |

(Evaluation Method)

After borderless images were recorded using each of the combinations in Embodiments 1–15 and Comparative Examples 1–3, the state of the agglomerates (chemical compounds) on the platen in the inkjet recording apparatus, and on the reverse side of the PPC papers used for recording, were visually evaluated by the inventors of the present invention. When the state of the contamination by the chemical compounds was tolerable, it was given a "G" mark, whereas when the state of the contamination was intolerable, it was given an "NG"mark.

(Evaluation Results)

Table 9 shows the results of the evaluation of the contamination on the platen and the reverse side of the recording medium, which occurred in Embodiments 1–15 and Comparative Examples 1–3.

TABLE 9

| | PLATEN CONTAMINATION | SHEET BACK CONTAMINATION |
|---|---|---|
| EMB. 1 | G | G |
| EMB. 2 | G | G |
| EMB. 3 | G | G |
| EMB. 4 | G | G |
| EMB. 5 | G | G |
| EMB. 6 | G | G |
| EMB. 7 | G | G |
| EMB. 8 | G | G |
| EMB. 9 | G | G |
| EMB. 10 | G | G |
| EMB. 11 | G | G |
| EMB. 12 | G | G |

TABLE 9-continued

| | PLATEN CONTAMINATION | SHEET BACK CONTAMINATION |
|---|---|---|
| EMB. 13 | G | G |
| EMB. 14 | G | G |
| EMB. 15 | G | G |
| COMP. 1 | NG | NG |
| COMP. 2 | NG | NG |
| COMP. 3 | NG | NG |

G: GOOD
NG: NO GOOD

As described above, by employing a recording method which reduces the amount by which mist is formed when borderless images (images without margins) are recorded, it was possible to reduce the amount by which the chemical compounds adhere to the interior of an inkjet recording apparatus, and the reverse side of a recording medium.

Further, by employing a recording method which prevents reactive liquid from being ejected onto the edge region of a recording medium, as well as outward of the edge of the recording medium when borderless images (images without margins) are recorded, or a recording method which reduces the amount by which reactive liquid is ejected onto the edge region of a recording medium, as well as outward of the edge of the recording medium when borderless images (images without margins) are recorded, it was possible to minimize the deterioration of the absorbency of the absorbent member.

(Miscellanies)

Obviously, the primary object of the present invention can also be accomplished in the following method: a storage medium storing the program codes of software for realizing the functions in the above-described embodiments is supplied to a system or an apparatus, and the functions are realized by reading and carrying out the program codes stored in the storage medium with the use of the computer (or CPU or MPU) of the system or apparatus.

In this case, the program codes themselves read out of the storage medium realize the functions in the above-described embodiments, and the storage medium storing the program codes constitutes the present invention.

As the recording media for supplying the program codes, a floppy disc, a hard disc, an optical disc, a photomagnetic disc, a CD-ROM, a CD-R, a magnetic tape, a nonvolatile memory card, and a ROM, for example, can be used.

Needless to say, not only does the invention include the case in which the functions in the above-described embodiments are realized as the computer executes the program codes it reads out, but also the case in which they are realized as the operating system on which the computer is based, or the like, carries out a part, or the entirety, of the actual procedure, according to the instructions of the program codes.

Further, it is also obvious that the invention includes the case in which the program codes read out of the storage medium are written into the memories of a feature expansion board inserted into the computer, or the memories equipped in a feature extension unit connected to the computer, and as the CPU or the like in the feature expansion board or feature expansion board partially or entirely carries out the actual procedure, the functions in the above-described embodiments are realized by the procedure.

When the present invention is applied to the above-described storage medium, program codes corresponding to, for example, the flowchart shown in FIG. 7 are stored in this storage medium.

The present invention is usable with any inkjet recording system, in particular, an inkjet recording system comprising a means for generating thermal energy as the energy used for ink ejection (electrothermal transducer, laser beam or the like), and is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response.

The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124, because the employment of such conditions makes it possible to produce far superior images.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion.

The present invention is effectively applicable to a so-called full-line type recording head having a length corresponding to the maximum recording width. Such a recording head may comprise a single recording head or plural recording heads combined to cover the maximum width.

In addition, the present invention is applicable to a replaceable chip-type recording head which is connected electrically with the main apparatus and can be supplied with the ink when it is mounted in the main assembly, or to a cartridge-type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or suction means, preliminary heating means which may be the electrothermal transducer, an additional heating element or a combination thereof. Also, means for effecting preliminary ejection (not for the recording operation) can stabilize the recording operation.

The present invention is effectively applicable to an apparatus having at least one of a monochromatic mode for recording mainly with black, a multi-color mode for recording with different color ink materials and a full-color mode for recording using a mixture of the colors, which may be an integrally formed recording unit or a combination of plural recording heads.

Furthermore, in the foregoing embodiments, the ink has been liquid. It may be, however, an ink material which is solidified below room temperature but liquefied at room temperature. Since the ink is controlled within a temperature range not lower than 30° C. and not higher than 70° C. to stabilize the viscosity of the ink to provide the stabilized ejection in a usual recording apparatus of this type, the ink may be such that it is liquid within the temperature range when the recording signal in the present invention is applied. The invention is also applicable to other types of ink.

In one of them, the temperature rise due to the thermal energy is positively prevented by consuming it for the state change of the ink from the solid state to the liquid state. Another ink material is solidified when it is left unused, to prevent the evaporation of the ink. In either of these cases, by the application of the recording signal producing thermal energy, the ink is liquefied so that the liquefied ink can be ejected. Another ink material may start to be solidified at the time when it reaches the recording material The present invention is also applicable to such an ink material as is liquefied by the application of the thermal energy.

Such an ink material may be retained as a liquid or solid material in through-holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

As described above, according to the present invention, when recording borderless images (images without margins) using the combination of ink and reactive liquid capable of reacting with the ink, it is possible to reduce the amount by which the interior of an inkjet recording apparatus and the reverse side of a recording medium are contaminated, or to prevent the contamination. Also according to the present invention, it is possible to prevent the reactive liquid from being ejected outward of the edge of a recording medium, preventing therefore the deterioration of an absorbent member in its capacity of absorbing the ink ejected outward of the recording medium. Further, it is possible to vary the recording conditions (ink ejection conditions, reactive liquid ejection conditions, scan count, and the like) depending on which recording mode is selected, a first mode (borderless recording mode) in which images are recorded with the provision of no margin at least at one of the four edges of a recording medium, or a second mode (normal recording mode) in which images are recorded with the provision of margins along all of the four edges of the recording medium, making it possible to realize optimal images recordable in the selected mode.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of end portions of the recording material and a second recording mode in which margins are provided at all of the end portions of the recording material, wherein an amount of application of the reaction liquid in the first recording mode is smaller than an amount of application of the reaction liquid in the second recording mode.

2. A method according to claim 1, wherein the amount of application of the reaction liquid is decreased by increasing a thinning rate of the reaction liquid in the first recording mode.

3. A method according to claim 1, wherein the amount of application of the reaction liquid is decreased by decreasing an amount per droplet of the reaction liquid in the first recording mode.

4. A method according to claim 1, wherein the amount of application of the reaction liquid is decreased by not ejecting the reaction liquid in the first recording mode.

5. A method according to claim 1, wherein an amount of application of the reaction liquid to an end area of the recording material is smaller than an amount of application of the reaction liquid to an area other than the end area in the first recording mode.

6. A method according to claim 5, wherein the reaction liquid is not ejected to the end area of the recording material in the first recording mode.

7. A method according to claim 1, wherein an amount of application of the reaction liquid to an outer area of the recording material is smaller than an amount of application of the reaction liquid to the recording material in the first recording mode.

8. A method according to claim 7, wherein the reaction liquid is not ejected to an outer area of the recording material in the first recording mode.

9. A method according to claim 1, further comprising a detection step of detecting a selected one of a plurality of recording modes including the first recording mode and the second recording mode.

10. A method according to claim 9, wherein in said detection step, the selected mode is detected on the basis of information relating to the recording modes from an external device connected to a recording device effecting the ink jet recording method or on the basis of information obtained by communication with an external device.

11. A method according to claim 9, wherein in said detection step, the selected recording mode is detected on the basis of information relating to the recording modes provided by a switch of a recording device effecting the ink jet recording method.

12. A method according to claim 9, wherein in said detection step, the selected recording mode is detected on the basis of information relating to a property of the image data inputted to a recording device effecting the ink jet recording method.

13. A method according to claim 9, wherein in said detection step, the selected recording mode is detected on the basis of information relating to a property of the recording material which is used.

14. A method according to claim 1, wherein the reaction liquid is black ink, and the ink is non-black color ink.

15. A method according to claim 1, wherein the reaction liquid has a property of improving a waterproof property of an image formed by the ink on the recording material.

16. A method according to claim 1, wherein the reaction liquid has a property of improving a coloring property of an image formed by the ink on the recording material.

17. A method according to claim 1, wherein the ink is anionic or cationic ink, and the reaction liquid contains liquid composition including dispersed fine particles having surfaces electrically charged to a polarity opposite that of the ink.

18. A method according to claim 17, wherein in a colored portion provided by the ink and the liquid composition, the coloring material in the ink is adsorbed on the surfaces of the fine particles in a monomolecular state.

19. A method according to claim 17, wherein the fine particles are alumina or hydrated alumina particles.

20. A method according to claim 1, further comprising a preparation step of preparing data for recording ink ejection and ejection data for the reaction liquid in the first recording mode when the first recording mode is selected, and preparing data for recording ink ejection and ejection data for the reaction liquid in the second recording mode when the second recording mode is selected.

21. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of end portions of the recording material and a second recording mode in which margins are provided at all of the end portions of the recording material, wherein at least one of an amount of application of the ink and an amount of application of the reaction liquid is smaller in the first recording mode than in the second recording mode.

22. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of end portions of the recording material and a second recording mode in which margins are provided at all of the end portions of the recording material, wherein a process for reducing at least one of an amount of mist of the ink and an amount of mist of the reaction liquid in the first recording mode is different from that in the second recording mode.

23. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of the end portions of the recording material and a second recording mode in which margins are provided at all of the end portions of the recording material, wherein in said recording step, the ink and the reaction liquid are ejected from the ink ejection portion and the reaction liquid ejection portion while the ink ejection portion and the reaction liquid ejection portion scan across the recording material, wherein a number of scans for the ejection is different depending on whether the ejection is in the first recording mode or the second recording mode.

24. A method according to claim 23, wherein the number of scans is larger in the first recording mode than in the second recording mode.

25. A method according to claim 24, wherein in the first recording mode, the recording is effected with a plurality of scans for a predetermined recording area of the recording material, and in the second recording mode, the recording is effected with one scan for the predetermined recording area.

26. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of end portions of the recording material and a second recording mode in which margins are provided at all of the end portions of the recording material, wherein in said recording step, the ink and the reaction liquid are ejected from the ink ejection portion and the reaction liquid ejection portion, respectively, while the ink ejection portion and the reaction liquid ejection portion scan across the recording medium, and wherein an application area of the ink is larger than an application area of the reaction liquid in the first recording mode, and the application area of the ink is substantially the same as the application area of the reaction liquid in the second recording mode.

27. An ink jet recording apparatus for performing recording on a recording material by ejecting ink including coloring material from an ink ejection portion and ejecting reaction liquid reactable with the ink from a reaction liquid ejection portion, said apparatus comprising:

recording means for performing the recording selectively in a first recording mode in which no margin is provided at least at one of end portions of the recording material and a second recording mode in which margins are provided at all of the end portions of the recording material, wherein the recording in the first recording mode is performed using the ink without using the reaction liquid and the recording in the second recording mode is performed using the ink and the reaction liquid.

28. A control program for computer control of an ink jet recording method for effecting recording on a recording material by ejecting ink including coloring material from an ink ejection portion and ejecting reaction liquid reactable with the ink from a reaction liquid ejection portion, said program comprising:

a discrimination step of discriminating a selected mode of a first recording mode in which no margin is provided at least at one of end portions of the recording material and a second recording mode in which margins are provided at all of the end portions of the recording material; and a preparation step of preparing data for recording ink ejection in the first recording mode when said discrimination step discriminates that the first recording mode is selected, and preparing data for recording ink ejection and ejection data for the reaction liquid in the second recording mode when said discrimination step discriminates that the second recording mode is selected, wherein the recording in the first recording mode is performed using the ink without using the reaction liquid and the recording in the second recording mode is performed using the ink and the reaction liquid.

29. A storage medium readable by a computer storing the control program recited in claim 28.

30. An ink jet recording method for effecting recording on a recording material by ejecting ink including coloring material from an ink ejection portion and ejecting reaction liquid reactable with the ink from a reaction liquid ejection portion, said method comprising:

a recording step of effecting the recording selectively in a first recording mode in which no margin is provided at least at one of end portions of the recording material and a second recording mode in which margins are provided at all of the end portions of the recording material, wherein the recording in the first recording mode is performed using the ink without using the reaction liquid and the recording in the second recording mode is performed using the ink and the reaction liquid.

31. An inkjet recording apparatus comprising:

recording means for performing recording on a recording material by ejecting ink including coloring material from an ink ejection portion and ejecting reaction liquid reactable with the ink from a reaction liquid ejection portion, when performing a recording mode for recording while providing no margin at least at one of end portions of the recording material, wherein an amount of application of the reaction liquid to the at least one end portion of the recording material is smaller than an amount of application of the reaction liquid to a predetermined area other than the at least one end portion.

32. An apparatus according to claim 31, wherein a thinning rate of the reaction liquid in the at least one end portion is larger than a thinning rate of the reaction liquid in the predetermined area.

33. An apparatus according to claim 31, wherein an amount per droplet of the reaction liquid in the at least one end portion is smaller than an amount per droplet of the reaction liquid in the predetermined area.

34. An inkjet recording apparatus comprising:

recording means for performing recording on a recording material by ejecting ink including coloring material from an ink ejection portion and ejecting reaction liquid reactable with the ink from a reaction liquid ejection portion, when performing a recording mode for recording while providing no margin at least at one of end portions of the recording material, wherein the reaction liquid is not ejected to the at least one end portion of the recording material and the reaction liquid is ejected to a predetermined area other than the at least one end portion.

35. An ink jet recording apparatus, comprising:

recording means for performing recording on a recording material by ejecting ink including coloring material from an ink ejection portion and ejecting reaction liquid reactable with the ink from a reaction liquid ejection portion, when performing a recording mode for recording while providing no margin at least at one of end portions of the recording material, wherein an amount of application of the reaction liquid to the at least one end portion of the recording material is smaller than an amount of application of the reaction liquid to a predetermined area in the recording material.

36. An apparatus according to claim 35, wherein a thinning rate of the reaction liquid in the at least one end portion is larger than a thinning rate of the reaction liquid in the predetermined area.

37. An apparatus according to claim 35, wherein an amount per droplet of the reaction liquid in the at least one end portion is smaller than an amount per droplet of the reaction liquid in the predetermined area.

38. An inkjet recording apparatus comprising:

recording means for performing recording on a recording material by ejecting ink including coloring material from an ink ejection portion and ejecting reaction liquid reactable with the ink from a reaction liquid ejection portion, when performing a recording mode for recording while providing no margin on at least one of end portions of the recording material, wherein the reaction liquid is not ejected to the at least one end portion of the recording material and the reaction liquid is ejected to a predetermined area in the recording material.

* * * * *

UNITED STATES PATENT AND TRADEMARK OFFICE

CERTIFICATE OF CORRECTION

PATENT NO. : 6,991,327 B2
APPLICATION NO. : 10/137382
DATED : January 31, 2006
INVENTOR(S) : Fumitaka Goto et al.

It is certified that error appears in the above-identified patent and that said Letters Patent is hereby corrected as shown below:

COLUMN 8:
Line 10, "thereof" should read --thereof.--.

COLUMN 14:
Line 8, "8" should read --(8--.

COLUMN 18:
Line 67, "may" should read --may be--.

COLUMN 26:
Line 23, "regarding the" should read --regarding--.

COLUMN 29:
Line 63, "1" should read --I--.
Line 64, "1" should read --I--.

COLUMN 37:
Line 30, "material" should read --material.--.

Signed and Sealed this

Nineteenth Day of June, 2007

JON W. DUDAS
*Director of the United States Patent and Trademark Office*